US009913038B2

(12) United States Patent
Pan

(10) Patent No.: US 9,913,038 B2
(45) Date of Patent: Mar. 6, 2018

(54) MULTI-CHANNEL HEADPHONE

(71) Applicants: OBO PRO.2 INC., Taoyuan (TW); Chien-Chuan Pan, New Taipei (TW)

(72) Inventor: Chien-Chuan Pan, New Taipei (TW)

( * ) Notice: Subject to any disclaimer, the term of this patent is extended or adjusted under 35 U.S.C. 154(b) by 0 days.

(21) Appl. No.: 15/394,815

(22) Filed: Dec. 30, 2016

(65) Prior Publication Data

US 2017/0111741 A1 Apr. 20, 2017

Related U.S. Application Data

(62) Division of application No. 14/169,562, filed on Jan. 31, 2014, now Pat. No. 9,571,933.

(51) Int. Cl.

| | |
|---|---|
| ***H04R 25/00*** | (2006.01) |
| ***H04R 5/033*** | (2006.01) |
| ***H04R 1/24*** | (2006.01) |
| *H04R 11/02* | (2006.01) |
| *H04R 9/06* | (2006.01) |
| *H04R 1/10* | (2006.01) |

(52) U.S. Cl.

CPC ..... *H04R 5/033* (2013.01); *H04R 1/24* (2013.01); *H04R 1/1008* (2013.01); *H04R 9/06* (2013.01); *H04R 11/02* (2013.01); *H04R 2205/022* (2013.01)

(58) Field of Classification Search

CPC ..... H04R 5/033; H04R 1/24; H04R 1/1008; H04R 9/06; H04R 11/02; H04R 2205/022

USPC ..... 381/309, 182, 380, 381, 328, 151

See application file for complete search history.

(56) References Cited

U.S. PATENT DOCUMENTS

| | | | | |
|---|---|---|---|---|
| 4,993,065 | A * | 2/1991 | Chiou | H04M 1/05 379/430 |
| 8,515,103 | B2 * | 8/2013 | Mei | H04R 1/1016 381/309 |
| 8,885,866 | B2 * | 11/2014 | Sakaguchi | H04R 1/1058 381/380 |
| 8,948,435 | B2 * | 2/2015 | Oosato | H04R 1/1075 381/328 |
| 9,191,731 | B2 * | 11/2015 | Huang | H04R 1/24 |
| 9,237,394 | B2 * | 1/2016 | Seo | H04R 1/1016 |
| 9,369,791 | B2 * | 6/2016 | Tanaka | H04R 1/1016 |
| 9,571,933 | B2 * | 2/2017 | Pan | H04R 1/1075 |
| 9,615,162 | B2 * | 4/2017 | Huang | H04R 1/1091 |
| 2004/0165720 | A1 * | 8/2004 | Paulson | H04B 1/385 379/431 |
| 2006/0133631 | A1 * | 6/2006 | Harvey | H04R 1/1016 381/312 |
| 2006/0133636 | A1 * | 6/2006 | Harvey | H04R 1/1016 381/380 |
| 2006/0256992 | A1 * | 11/2006 | Liao | H04R 1/1041 381/371 |
| 2007/0036385 | A1 * | 2/2007 | Harvey | H04R 1/2819 381/388 |

(Continued)

*Primary Examiner* — Davetta W Goins
*Assistant Examiner* — Phylesha Dabney

(57) ABSTRACT

A multi-channel headphone has a housing, multiple independent sound channels formed in the housing, and at least one speaker unit mounted inside the housing. The at least one speaker unit produces sound directly passing through one of the sound channels and refracted through the rest of sound channels. As the refracted sound is slower than the directly travelling sound, multiple layers of auditory feeling can be provided and a stereo sound effect can be generated for users to enjoy better auditory feeling.

4 Claims, 25 Drawing Sheets

(56) References Cited

U.S. PATENT DOCUMENTS

| | | | | |
|---|---|---|---|---|
| 2007/0053540 | A1* | 3/2007 | Harvey | H04R 1/22 381/380 |
| 2008/0056526 | A1* | 3/2008 | Dunn | H04R 1/1016 381/380 |
| 2009/0022352 | A1* | 1/2009 | Weibel | H04R 1/1066 381/378 |
| 2009/0220113 | A1* | 9/2009 | Tiscareno | H04R 1/403 381/309 |
| 2009/0233652 | A1* | 9/2009 | Yang | H04R 31/006 455/569.1 |
| 2009/0279729 | A1* | 11/2009 | Huang | H04R 1/1016 381/345 |
| 2011/0116670 | A1* | 5/2011 | Lasserre | H04R 1/24 381/345 |
| 2012/0070022 | A1* | 3/2012 | Saiki | H04R 9/063 381/312 |
| 2012/0076341 | A1* | 3/2012 | Ozawa | H04R 1/345 381/380 |
| 2012/0201406 | A1* | 8/2012 | Yamaguchi | H04R 1/1016 381/309 |
| 2014/0140565 | A1* | 5/2014 | Liu | H04R 1/1091 381/380 |
| 2014/0205131 | A1* | 7/2014 | Azmi | H04R 1/1075 381/380 |
| 2016/0302000 | A1* | 10/2016 | Shin | H04R 1/1083 |

* cited by examiner

MULTI-CHANNEL HEADPHONE

CROSS REFERENCE TO RELATED APPLICATIONS

The present application is a divisional application of U.S. patent application Ser. No. 14/169,562, entitled "Multi-Channel Headphone" fled on Jan. 31, 2014, which is incorporated herein by reference.

FIELD OF THE INVENTION

The present invention relates to a headphone, and more particularly to a multi-channel headphone with a stereo sound effect through multiple sound guiding channels.

DESCRIPTION OF THE PRIOR ART

Headphones are connected to audio source devices for users to listen audio information outputted from the audio source devices after users wear the headphones, the audio source devices output electronic signals to the headphones, and the headphones convert the electronic signals into audible sound.

As disclosed in a Taiwanese Patent Publication No. 201216725 entitled "Headphone", a conventional headphone has a housing, a bracket, a first speaker unit, and a second speaker unit. The body has a main audio output channel. The bracket disposed inside the housing includes a front plate, a first tube portion, a second tube portion and a connecting portion. The front plate has a central hole and multiple surrounding holes around the central hole. The first tube portion is connected to the front plate and has a first accommodating space. The second tube portion is separated from the first tube portion and has a second accommodating space. The first accommodating space communicates with the main audio output channel through the central hole. The second accommodating space communicates with the main audio output channel through the surrounding holes. The first speaker unit is disposed in the first accommodating space, and the second speaker is disposed in the second accommodating space.

Sound generated by the first speaker unit propagates to the main audio output channel through the central hole, and sound generated by the second speaker unit propagates to the main audio output channel through the surrounding holes. Sound generated by the first and second speaker units are mixed in the main audio output channel before propagating to a user's ears so as to provide a wider audio output frequency and a uniform frequency response.

However, despite a choice of a wider audio output frequency, the foregoing conventional headphone still has the structure that one audio output channel is available at only one side of the headphone. It means that users can only listen two-channel audio output instead of a stereo sound effect provided by more than two audio output channels.

The present invention has arisen to mitigate and/or obviate the afore-described disadvantages.

SUMMARY OF THE INVENTION

An objective of the present invention is to provide a multi-channel headphone providing multiple layers of auditory feeling and a stereo sound effect with sound travelling through direct and indirect sound channels.

To achieve the foregoing objective, the multi-channel headphone has a housing and a speaker unit.

The housing has multiple audio output holes formed in the housing.

The speaker unit is mounted inside the housing and has multiple sound-generating parts mounted in the speaker unit. Sound produced by one of the sound-generating parts directly travels through one of the audio output holes, and sound produced by at least one another sound-generating part indirectly travels through the respective audio output hole.

To achieve the foregoing objective, the multi-channel headphone has a housing and multiple speaker units.

The housing has multiple audio output holes formed in the housing.

The speaker units are mounted inside the housing. Each speaker unit has a sound-generating part mounted thereon. Sound produced by one of the sound-generating parts directly travels through one of the audio output holes, and sound produced by the rest of sound-generating parts indirectly travels through the rest of the audio output holes.

To achieve the foregoing objective, the multi-channel headphone has two speaker units and a headband.

Each speaker unit has a housing and a speaker.

The housing has multiple audio output holes formed in the housing. The speaker is mounted inside the housing and has two sound-generating parts. The sound produced by one of the sound-generating parts directly travels through one of the audio output holes, and sound produced by the other sound-generating part indirectly travels through the other audio output hole.

The headband is connected between the two speaker units with the speaker units symmetrically arranged.

To achieve the foregoing objective, the multi-channel headphone has a housing and a speaker unit.

The housing having two audio output holes formed in the housing.

The speaker unit is mounted inside the housing and has two sound-generating parts mounted on the speaker unit. The sound produced by one of the sound-generating parts indirectly travels through one of the audio output holes, and sound produced by the other sound-generating part indirectly travels through the other audio output hole.

Given the foregoing multi-channel headphones, sound produced by one or more speaker units can travel to the auditory canal of the outer ear of a user through multiple independent sound channels for the produced sound to directly travel through or to be refracted and then travel through. Accordingly, multiple layers of auditory feeling and a stereo sound effect can be achieved for the sake of varying time for sound to reach the auditory canal through the different sound channels.

Other objectives, advantages and novel features of the invention will become more apparent from the following detailed description when taken in conjunction with the accompanying drawings.

DETAILED DESCRIPTION OF THE PREFERRED EMBODIMENTS

To define necessary directions in the following description, "inner" direction specifies a direction proximal to the auditory canal of an outer ear of a user, and "outer" direction specifies a direction distal to the auditory canal of the outer ear of the user.

Figure 1:
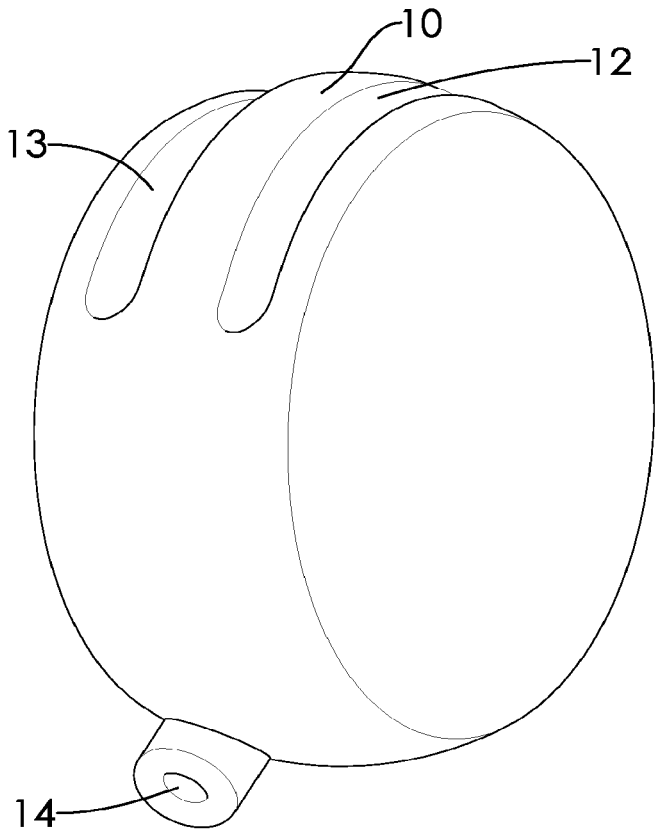
FIG. 1 is a perspective view of a first embodiment of a multi-channel headphone in accordance with the present invention.
Figure 2A:
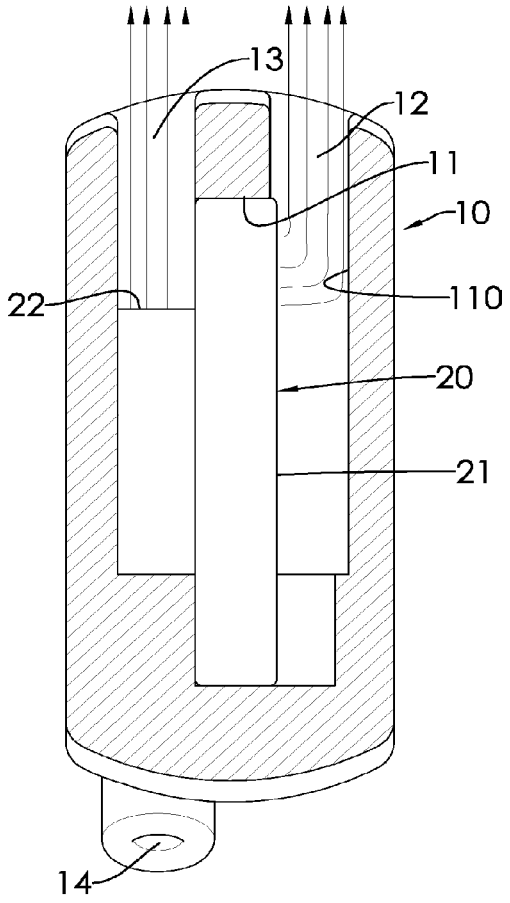
FIG. 2A is a side view in section of the multi-channel headphone in FIG. 1.

With reference to FIGS. 1 and 2A, a first embodiment of a multi-channel headphone in accordance with the present invention has a housing 10 and a speaker unit 20.

The housing 10 is cylindrical and has a compartment 11, a first audio output hole 12 and a second audio output hole 13 and a wire hole 14. The compartment 11 is defined inside the housing 10. The first audio output hole 12, the second audio output hole 13 and the wire hole 14 are formed on and recessed inwards from a curve surface of the housing 10 to communicate with the compartment 11. The speaker unit 20 is a moving-coil speaker and has a first sound-generating part 21 and a second sound-generating part 22 respectively formed on two opposite sides of the speaker unit 20. The speaker unit 20 is mounted inside the compartment 11 so that the first audio output hole 12 and the second audio output hole 13 do not communicate with each other. Circuitry of the speaker unit 20 extends beyond the housing 10 through the wire hole 14. Sound produced by the second sound-generating part 22 directly travels through an opening of the second audio output hole 13. A sound wall 110 is formed on an inner wall of the compartment 11 being opposite to and spaced apart from the first sound-generating part 21. Sound produced by the first sound-generating part 21 is retracted by the sound wall 110 first and then travels through the first audio output hole 12 instead of directly travelling the first audio output hole 12.

When the present embodiment is in use, the housing 10 is placed in the outer ear of a user's ear with the opening of the second audio output hole 13 directly facing the auditory canal of the outer ear and the first audio output hole 13 located in the pinna of the outer ear and facing an inner wall of the pinna. When the first sound-generating part 21 and the second sound-generating part 22 of the speaker unit 20 simultaneously produce sound, the sound produced by the second sound-generating part 22 travels to the auditory canal through the second audio output hole 13, and the sound produced by the first sound-generating part 21 is first refracted by the sound wall 110 and then travels to the auditory canal through the first audio output hole 12. As the sound produced by the first sound-generating part 21 is refracted before travelling to the auditory canal, the travelling speed of the sound produced by the first sound-generating part 21 to the auditory cannel is slower than that of the sound produced by the second sound-generating part 22 such that multiple layers of auditory feeling can be provided. Because the first audio output hole 12 and the second audio output hole 13 are independently formed and sound-travelling paths in the first and second audio output holes 12, 13 differ from each other, a stereo sound effect can be generated for users to enjoy better auditory feeling.

Figure 2B:
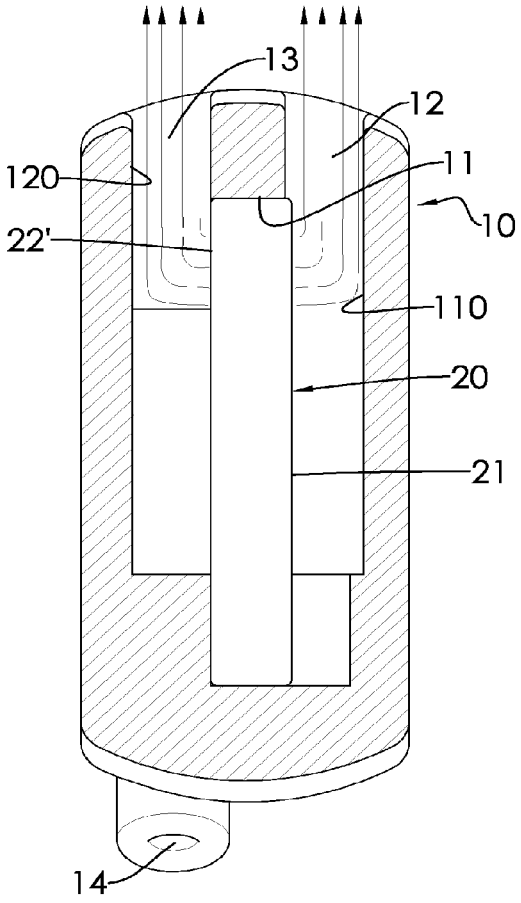
FIG. 2B is a side view in section of the multi-channel headphone in FIG. 1 with different layout in a speaker unit.

With reference to FIG. 2B, the second sound-generating part 22' may be arranged to face the opening of the second audio output hole 13. A first sound wall 110 is formed on an inner wall of the first audio output hole 12 and faces the first sound-generating part 21. Sound produced by the first sound-generating part 21 is refracted by the first sound wall 110 and then travels through an opening of the first audio output hole 12. A second sound wall 120 is formed on an inner wall of the second audio output hole 13 and faces the second sound-generating part 22'. Sound produced by the second sound-generating part 22' is retracted by the second sound wall 120 first and then travels through the second audio output hole 13.

When the present embodiment is in use, the housing 10 is placed in the outer ear of a user's ear with the opening of the first audio output hole 12 directly facing the auditory canal of the outer ear and the second audio output hole 13 located in the pinna of the outer ear and facing an inner wall of the pinna. When the first sound-generating part 21 and the second sound-generating part 22' of the speaker unit 20 simultaneously produce sound, the sound produced by the first sound-generating part 21 is refracted by the first sound wall 110 and then travels to the auditory canal through the first audio output hole 12, and the sound produced by the second sound-generating part 22' is first refracted by the second sound wall 120 and then travels to the auditory canal through the second audio output hole 13. As the sounds produced by the first sound-generating part 21 and the second sound-generating part 22' travel to the auditory canal through different paths, multiple layers of auditory feeling can be provided.

Figure 3:
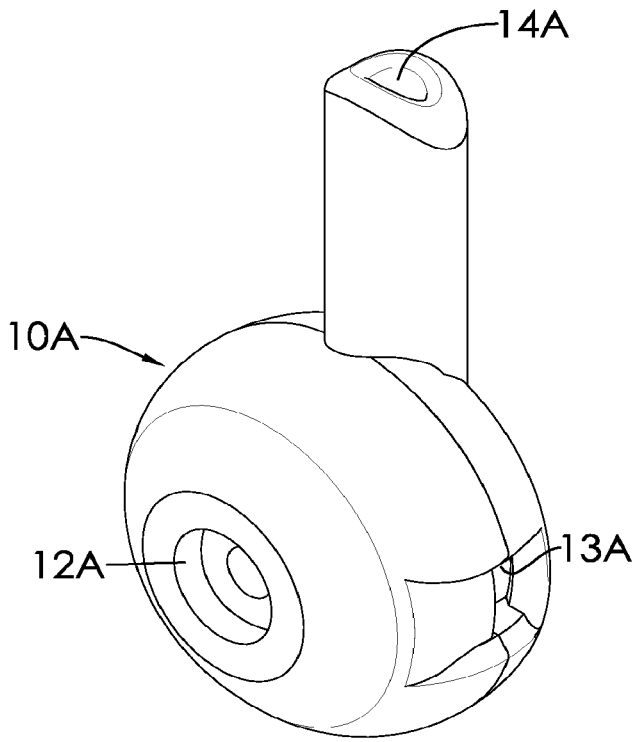
FIG. 3 is a perspective view of a second embodiment of a multi-channel headphone in accordance with the present invention.
Figure 4:
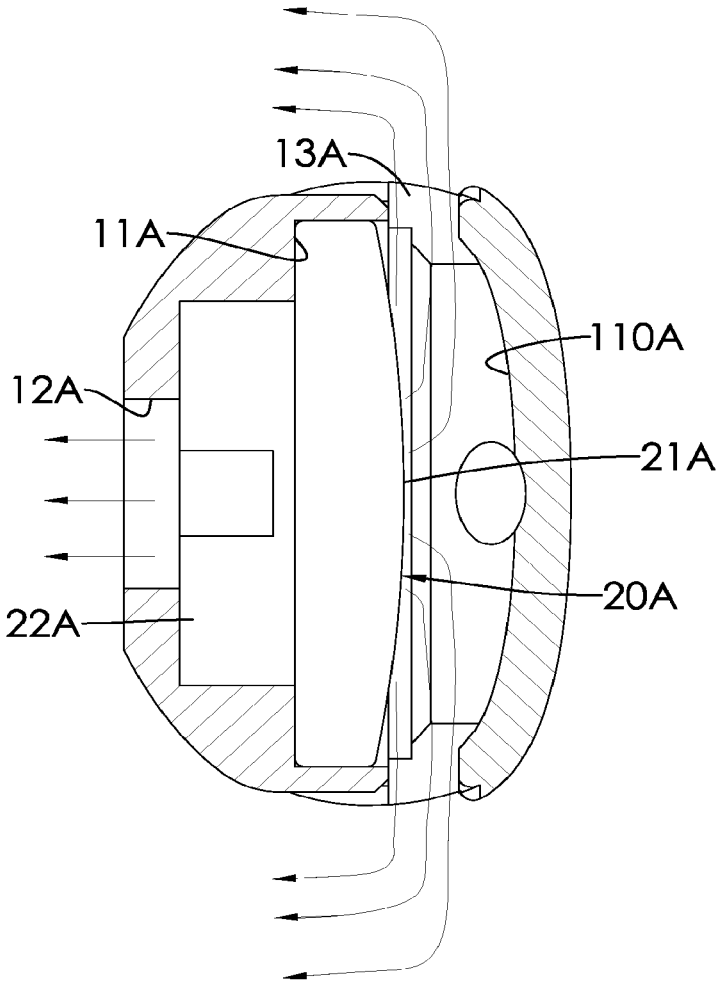
FIG. 4 is an enlarged cross-sectional view of the multi-channel headphone in FIG. 3.

With reference to FIGS. 3 and 4, a second embodiment of the multi-channel headphone in accordance with the present invention has a housing 10A and a speaker unit 20A.

The housing 10A is disc-shaped, and has a compartment 11A, a first audio output hole 12A, two second audio output holes 13A, and a wire hole 14A. The compartment 11A is defined inside the housing 10A. The first audio output hole 12A is formed on and recessed inwards from one of two end faces of the housing 10A. The second audio output holes 13A are laterally formed through the housing 10A with two openings oppositely located on an outer circumferential surface of the housing 10A. The wire hole 14A is formed on and recessed inwards from the outer circumferential surface of the housing 10A. The first audio output hole 12A, the second audio output holes 13A and the wire hole 14A communicate with the compartment 11A.

The speaker unit 20A is a moving-coil speaker, and has a first sound-generating part 22A and a second sound-generating part 21A respectively formed on two opposite sides of the speaker unit 20A. The speaker unit 20A is mounted inside the compartment 11A so that the first audio output hole 12A and the second audio output hole 13A do not communicate with each other. Circuitry of the speaker unit 20A extends beyond the housing 10A through the wire hole 14A. Sound produced by the first sound-generating part 22A directly travels through an opening of the first audio output hole 12A. An external side of the second sound-generating part 21A and an opposite inner wall of the compartment 11A are spaced apart. A sound wall 110A is formed on the opposite inner wall of the compartment 11A. Sound produced by the second sound-generating part 21A is refracted by the sound wall 110A first and then travels through the second audio output hole 13A instead of directly travelling through the second audio output hole 13A.

When the present embodiment is in use, the housing 10A is placed in the outer ear of a user's ear with the opening of the first audio output hole 12A directly facing the auditory canal of the outer ear and the second audio output hole 13A located in the pinna of the outer ear and facing an inner wall of the pinna. When the first sound-generating part 22A and the second sound-generating part 21A of the speaker unit 20 simultaneously produce sound, the sound produced by the first sound-generating part 22A travels to the auditory canal through the first audio output hole 12, and the sound produced by the second sound-generating part 21A is first refracted by the sound wall 110A and then travels to the auditory canal through the second audio output hole 13A. As the sound produced by the second sound-generating part 21A is refracted before travelling to the auditory canal, the travelling speed of the sound produced by the second sound-generating part 21A to the auditory cannel is slower than that of the sound produced by the first sound-generating part 22A such that multiple layers of auditory feeling can be provided. Because the first audio output hole 12 and the second audio output hole 13 are independently formed and sound-travelling paths in the first and second audio output holes 12, 13 differ from each other, a stereo sound effect can be generated for users to enjoy better auditory feeling.

Figure 5:
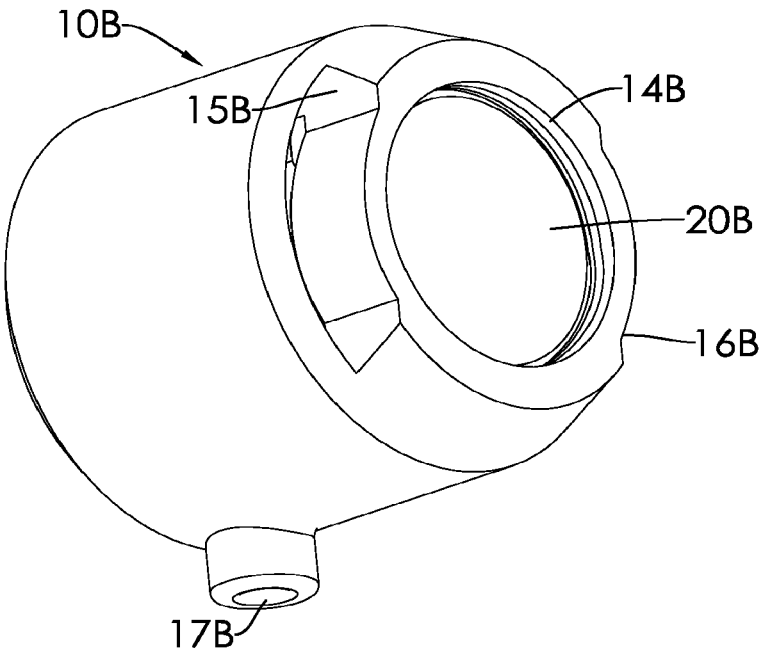
FIG. 5 is a perspective view of a third embodiment of a multi-channel headphone in accordance with the present invention.
Figure 6:
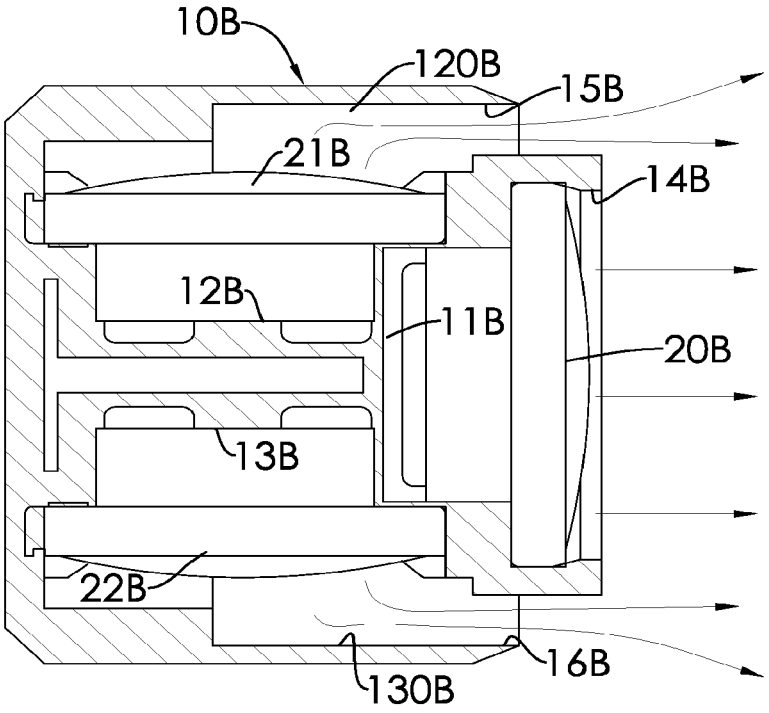
FIG. 6 is an enlarged cross-sectional view of the multi-channel headphone in FIG. 5.
Figure 7:
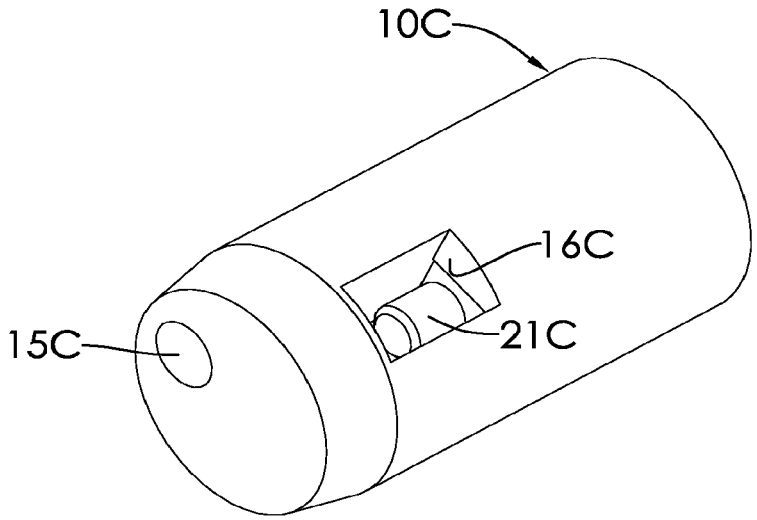
FIG. 7 is a perspective view of a fourth embodiment of a multi-channel headphone in accordance with the present invention.
Figure 8:
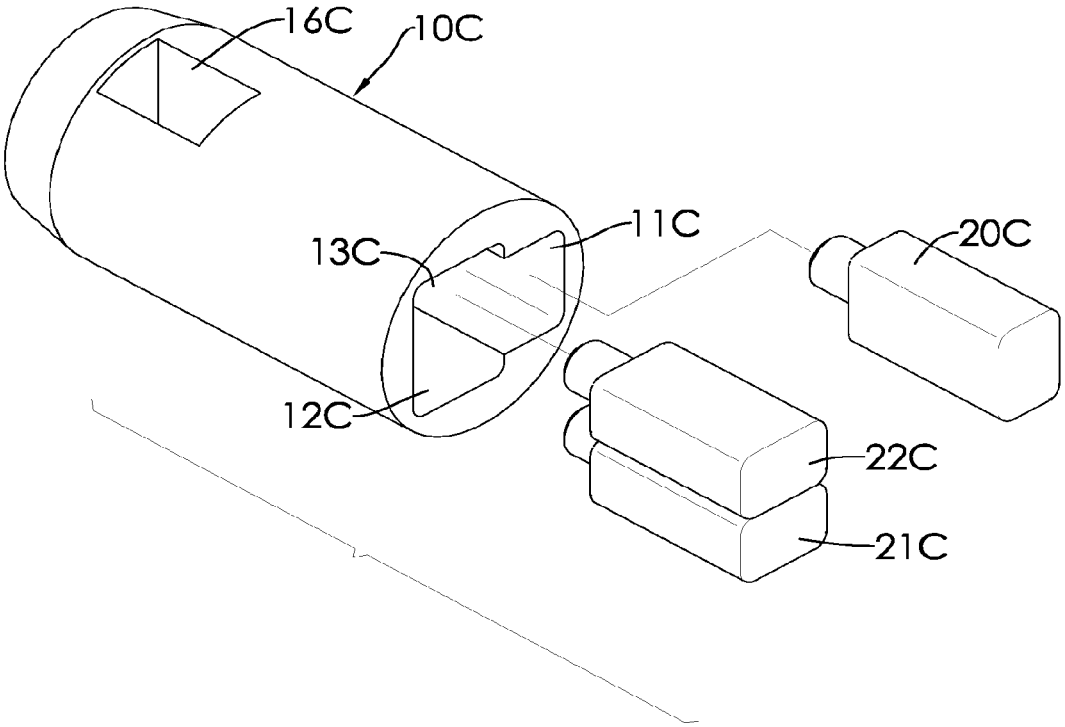
FIG. 8 is an exploded perspective view of the multi-channel headphone in FIG. 7.

With reference to FIGS. 5 and 6, a third embodiment of a multi-channel headphone in accordance with the present invention is an earplug type headphone, and has a housing 10B and three speaker units 20B, 21B, 22B.

The housing 10B is cylindrical, and has a first compartment 11B, a second compartment 12B, a third compartment 13B, a first audio output hole 14B, a second audio output hole 15B, a third audio output hole 16B, and a wire hole 17B. The first compartment 11B, the second compartment 12B and the third compartment 13B are partitioned inside the housing 10B. The first compartment 11B is adjacent to one of two end faces of the housing 10B. The second compartment 12B and the third compartment 13B are adjacent to a curve surface of the housing 10B. The first audio output hole 14B, the second audio output hole 15B and the third audio output hole 16B are formed on and recessed inwards from the end face adjacent to the first compartment, and the second audio output hole 15B and the third audio output hole 16B are formed beside the first audio output hole 14B. The first audio output hole 14B, the second audio output hole 15B and the third audio output hole 16B respectively communicate with the first compartment 11B, the second compartment 12B and the third compartment 13B. The wire hole 17B also communicates with the first compartment 11B, the second compartment 12B and the third compartment 13B.

A first sound-generating part is mounted on one side of each of the speaker units 20B, 21B, 22B. A second sound-generating part is mounted on an opposite side of each of the speaker units 20B, 21B, 22B. The speaker units 20B, 21B, 22B include a first speaker unit 20B, a second speaker unit 21B and a third speaker unit 22B. The first speaker unit 20B is mounted inside the first compartment 11B. The second speaker unit 21B is mounted inside the second compartment 12B. The third speaker unit 22B is mounted inside the third compartment 13B. Circuitries of the first, second and third speaker units 20B, 21B, 22B extend beyond the housing 10B through the wire hole 17B. Sound produced by the first sound-generating part of the first speaker unit 20B directly travels through an opening of the first audio output hole 14B. The first sound-generating part of the second speaker unit 21B and an inner wall of the second compartment 12B are spaced apart. A first sound wall 120B is formed on the inner wall of the second compartment 12B and faces the first sound-generating part of the second speaker unit 21B. Sound produced by the first sound-generating part of the second speaker unit 21B is refracted by the sound wall 120B before travelling through the second audio output hole 15B instead of directly travelling through the second audio output hole 15B. The first sound-generating part of the third speaker unit 22B and an inner wall of the third compartment 13B are spaced apart. A second sound wall 130B is formed on the inner wall of the third compartment 13B and faces the first sound-generating part of the third speaker unit 22B. Sound produced by the first sound-generating part of the third speaker unit 22B is refracted by the second sound wall 130B before travelling through the third audio output hole 16B instead of directly travelling through the third audio output hole 16B. The second sound-generating parts of the first, second and third speaker units 20B, 21B, 22B are adjacent to one another.

When the present embodiment is in use, the housing 10B is placed in the outer ear of a user's ear with the opening of the first audio output hole 14B directly facing the auditory canal of the outer ear and the second audio output hole 15B and the third audio output hole 16B located in the pinna of the outer ear and facing an inner wall of the pinna. When the first sound-generating part of the first speaker unit 20B produces sound, the produced sound travels to the auditory canal through the first audio output hole 14B. The sound produced by the first sound-generating part of the second speaker unit 21B is first refracted by the first sound wall 120B and then travels to the auditory canal through the second audio output hole 15B. The sound produced by the first sound-generating part of the third speaker unit 22B is first refracted by the second sound wall 130B and then travels to the auditory canal through the third audio output hole 16B. As the sound produced by the second speaker unit 21B and the third speaker unit 22B is refracted before travelling to the auditory canal, the travelling speed of the sound produced by the second speaker unit 21B and the third speaker unit 22B to the auditory cannel is slower than that of the sound produced by the first speaker unit 20B such that multiple layers of auditory feeling can be provided. Because the first audio output hole 14B, the second audio output hole 15B and the third audio output hole 16B are independently formed and sound-travelling paths in the first, second and third audio output holes 14B, 15B, 16B differ from one another, a stereo sound effect can be generated for users to enjoy better auditory feeling.

With reference to FIGS. 7 to 10, a fourth embodiment of a multi-channel headphone in accordance with the present invention has a housing 10C and three speaker units 20C, 21C, 22C.

The housing 10C is cylindrical and has a first compartment 11C, a second compartment 12C, a third compartment 13C, a first audio output hole 15C, a second audio output hole 16C, and a third audio output hole 17C. The first compartment 11C, the second compartment 12C and the third compartment 13 are mutually separated by partition walls 14C located adjacent to a first end of the housing 10C. The first audio output hole 15C is formed on and recessed inwards from the first end of the housing 10C, and longitudinally communicates with the first compartment 11C. The second audio output hole 16C and the third audio output hole 17C are radially and oppositely formed through a curve surface of the housing 10C, the second audio output hole 16C communicates with the second compartment 12C, and the third audio output hole 17C communicates with the third compartment 13C.

The speaker units 20C, 21C, 22C are balanced-armature speaker units and includes a first speaker unit 20C, a second speaker unit 21C and a third speaker unit 22C. A sound-generating part is mounted on a reduced neck end of each of the speaker units 20C, 21C, 22C. The first speaker unit 20C, the second speaker unit 21C and the third speaker unit 22C are respectively mounted inside the first compartment 11C, the second compartment 12C and the third compartment 13C. The sound-generating parts of the first, second and third speaker units 20C, 21C, 22C are blocked by the partition walls 14C and do not communicate with one another. Circuitries of the first, second and third speaker units 20C, 21C, 22C extend beyond the housing 10C through a second end of the housing opposite to the first end.

Figure 9:
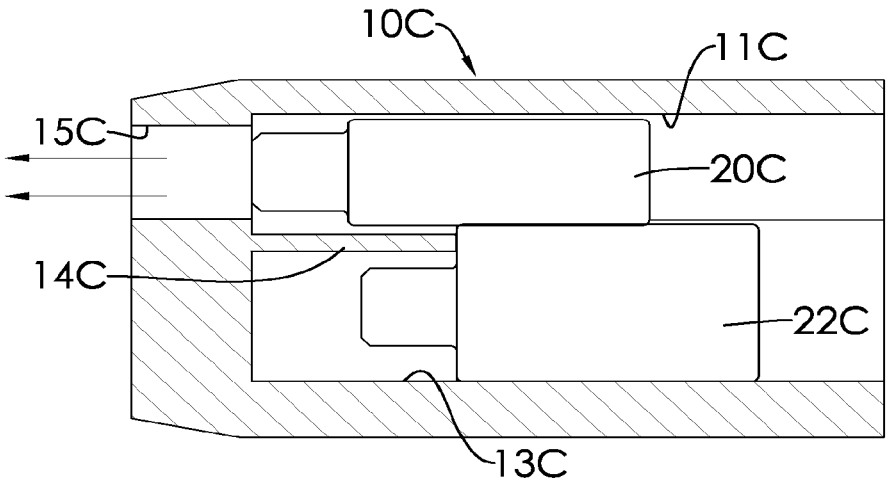
FIG. 9 is a cross-sectional view of the multi-channel headphone in FIG. 7.
Figure 10:
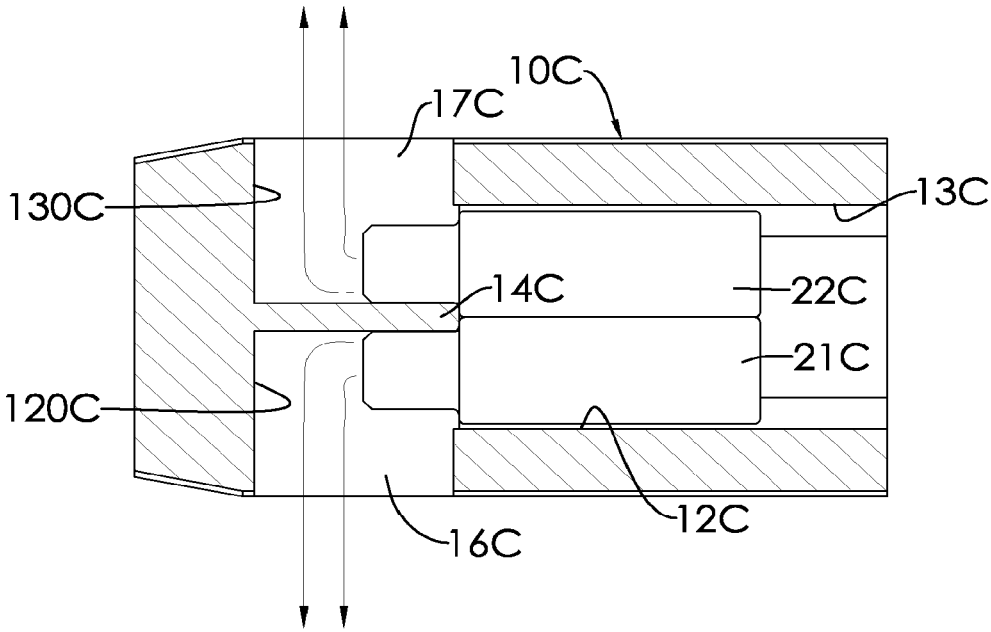
FIG. 10 is another cross-sectional view of the multi-channel headphone in FIG. 7.
Figure 11:
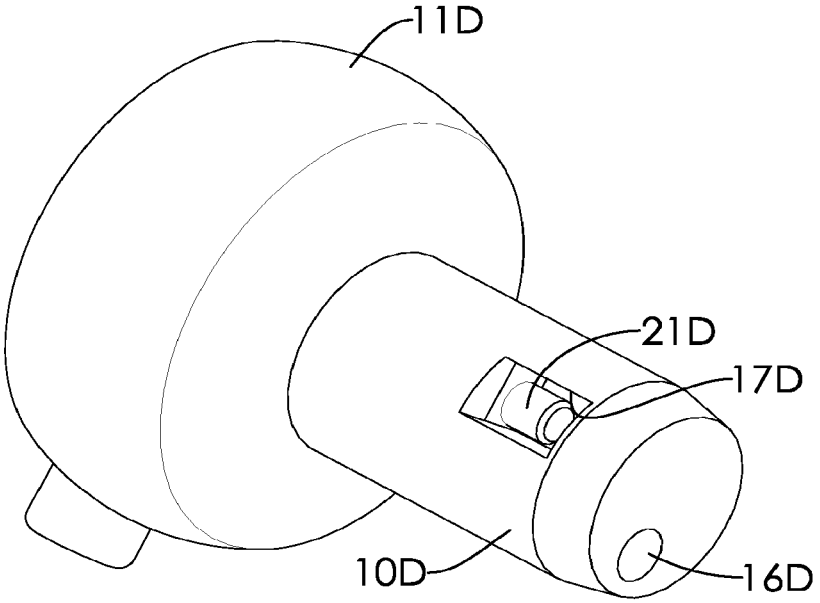
FIG. 11 is a perspective view of a fifth embodiment of a multi-channel headphone in accordance with the present invention.
Figure 12:
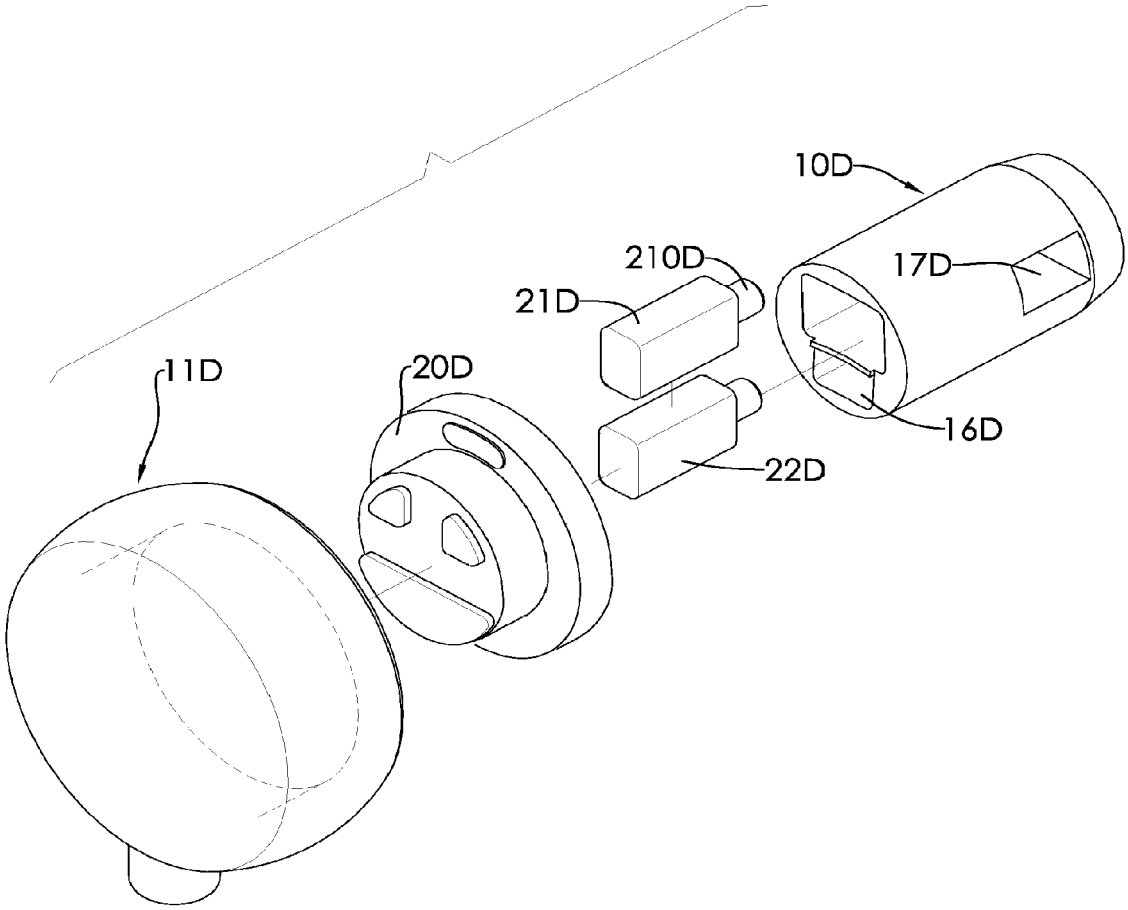
FIG. 12 is an exploded perspective view of the multi-channel headphone in FIG. 11.
Figure 13:
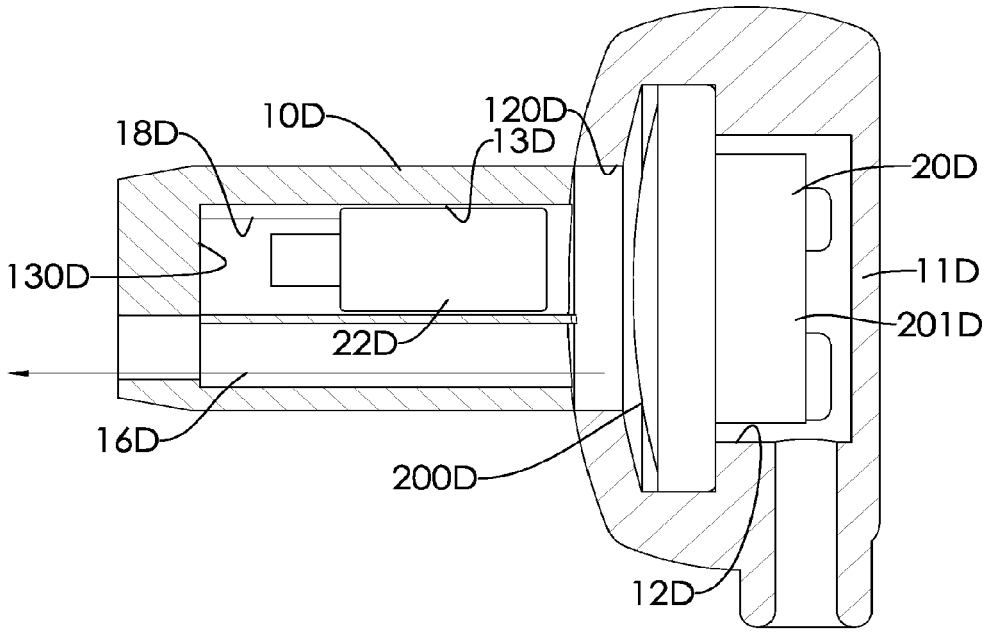
FIG. 13 is a cross-sectional view of the multi-channel headphone in FIG. 11.
Figure 14:
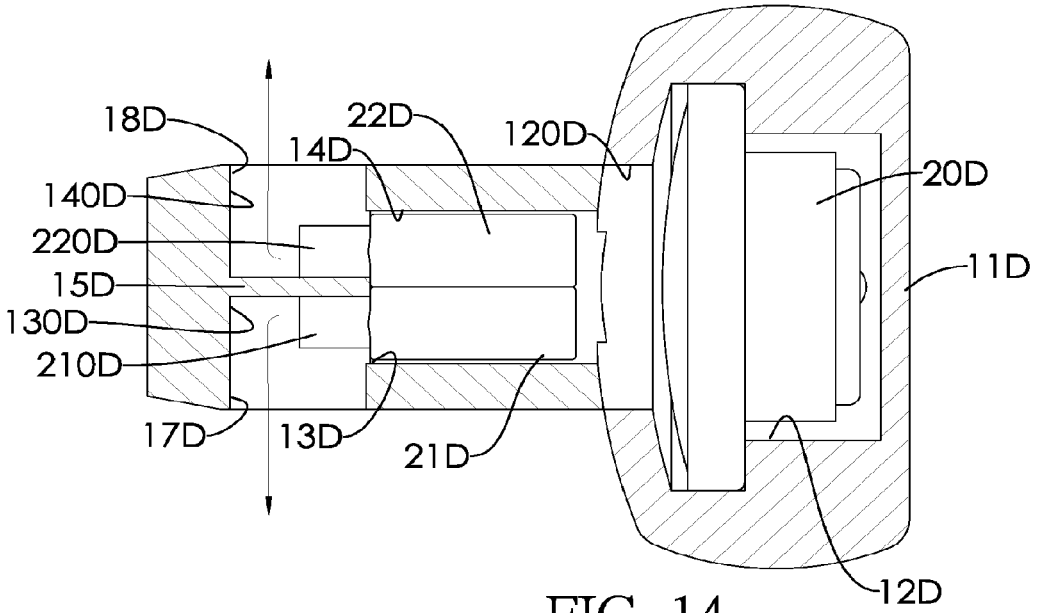
FIG. 14 is another cross-sectional view of the multi-channel headphone in FIG. 11.

With further reference to FIG. 9, sound produced by the sound-generating part of the first speaker unit 20C directly travels through the first audio output hole 15C. With further reference to FIG. 10, an external side of the sound-generating part of the second speaker unit 21C and an opposite inner wall of the second compartment 12C are spaced apart. A first sound wall 120C is formed on the opposite inner wall of the second compartment 12C. The sound-generating part of the second speaker unit 21C faces the first sound wall 120C instead of directly facing the second audio output hole 16C. An external side of the sound-generating part of the third speaker unit 22C and an opposite inner wall of the third compartment 13C are spaced apart. A second sound wall 130C is formed on the opposite inner wall of the third compartment 13C. Sound produced by the sound-generating part of the third speaker unit 22C is refracted by the second sound wall 130C before travelling through the second audio output hole 17C instead of directly travelling through the second audio output hole 17C.

When the present embodiment is in use, the housing 10C is placed in the outer ear of a user's ear with the opening of the first audio output hole 15C directly facing the auditory canal of the outer ear and the second audio output hole 16C and the third audio output hole 17C located in the pinna of the outer ear and facing an inner wall of the pinna. When the sound-generating part of the first speaker unit 20C produces sound, the produced sound travels to the auditory canal through the first audio output hole 15C. The sound produced by the second speaker unit 21C is first refracted by the first sound wall 120C and then travels to the auditory canal through the second audio output hole 16C. The sound produced by the third speaker unit 22C is first refracted by the second sound wall 130C and then travels to the auditory canal through the third audio output hole 17C. As the sound produced by the second speaker unit 21C and the third speaker unit 22C is refracted before travelling to the auditory canal, the travelling speed of the sound produced by the second speaker unit 21C and the third speaker unit 22C to the auditory cannel is slower than that of the sound produced by the first speaker unit 20C such that multiple layers of auditory feeling can be provided. Because the first audio output hole 15C, the second audio output hole 16C and the third audio output hole 17C are independently formed and sound-travelling paths in the first, second and third audio output holes 15C, 16C, 17C differ from one another, a stereo sound effect can be generated for users to enjoy better auditory feeling.

With reference to FIGS. 11 to 14, a fifth embodiment of a multi-channel headphone in accordance with the present invention is an earplug type headphone, and has a housing and three speaker units 20D, 21D, 22D.

The housing has an inner housing 10D and an outer housing 11D. The inner housing 10D is cylindrical. The inner housing 10D has a second compartment 13D, a third compartment 14D, a first audio output hole 16D, a second audio output hole 17D, and a third audio output hole 18D. The second compartment 13D and the third compartment 14D are formed in an outer end of the inner housing 10D, and a partition wall 15D is formed between the second compartment 13D and the third compartment 14D to separate the second compartment 13D and the third compartment 14D. The second compartment 13D and the third compartment 14D respectively have a second opening and a third opening at the outer end of the inner housing 10D. The first audio output hole 16D is longitudinally formed through the inner housing 10D. The second audio output hole 17D and the third audio output hole 18D are oppositely and radially formed on and recessed inwards from a curve surface of the inner housing 10D, and respectively communicate with the second compartment 13D and the third compartment 14D. The outer housing 11D is disc-shaped, is connected to the inner housing 10D, and has a first compartment 12D. The first compartment 12D is formed in an inner side of the outer housing 11D with a first opening 120D located at the inner side of the outer housing 11D. The first opening 120D of the outer housing 11D is connected to the outer end of the inner housing 10D. The first compartment 12D communicates with the first audio output hole 16D through the first opening 120D.

The speaker units 20D, 21D, 22D include a first speaker unit 20D, a second speaker unit 21D, and a third speaker unit 22D. The first speaker unit 20D is a moving-coil speaker, is disc-shaped, and has a first sound-generating part 200D and a second sound-generating part 201D respectively formed on two opposite sides of the first speaker unit 20D. The first speaker unit 20D is mounted inside the first compartment 12D with the first sound-generating part 200D facing the first opening 120D of the first compartment 12D and an opening of the second audio output hole 17D.

The second speaker unit 21D and the third speaker unit 22D are balanced-armature speakers, are cylindrical, and are respectively mounted inside the second compartment 13D and the third compartment 14D of the inner housing 10D. The second speaker unit 21D has a sound-generating part 210D mounted on one end thereof. The third speaker unit 22D has a sound-generating part 220D mounted on one end thereof. The sound-generating parts 210D, 220D of the second and third speaker units 21D, 22D are separated by a partition wall 15D without communicating with each other.

The second speaker unit 21D and an inner wall of the second compartment 13D is spaced apart. A first sound wall 130D is formed on the inner wall of the second compartment 13D. Sound produced by the sound-generating part 210D of the second speaker unit 21D is refracted by the first sound wall 130D before travelling through the second audio output hole 17D instead of directly travelling through the opening of the second audio output hole 17D. The third speaker unit 22D and an inner wall of the third compartment 14D is spaced apart. A second sound wall 140D is formed on the inner wall of the third compartment 14D. Sound produced by the sound-generating part 220D of the third speaker unit 22D is refracted by the second sound wall 140D before travelling through the third audio output hole 18D instead of directly travelling through the third audio output hole 18D.

When the present embodiment is in use, the housing 10D is placed in the outer ear of a user's ear with the opening of the first audio output hole 16D directly facing the auditory canal of the outer ear and the second audio output hole 17D and the third audio output hole 18D located in the pinna of the outer ear and facing an inner wall of the pinna. When the first sound-generating part 200D of the first speaker unit 20D produces sound, the produced sound travels to the auditory canal through the first audio output hole 16D. The sound produced by the sound-generating part 210D of the second speaker unit 21D is first refracted by the first sound wall 130D and then travels to the auditory canal through the second audio output hole 17D. The sound produced by the sound-generating part 220D of the third speaker unit 22D is first refracted by the second sound wall 140D and then travels to the auditory canal through the third audio output hole 18D. As the sound produced by the second speaker unit 21D and the third speaker unit 22D is refracted before travelling to the auditory canal, the travelling speed of the sound produced by the second speaker unit 21D and the third speaker unit 22D to the auditory cannel is slower than that of the sound produced by the first speaker unit 20D such that multiple layers of auditory feeling can be provided. Because the first audio output hole 16D, the second audio output hole 17D and the third audio output hole 18D are independently formed and sound-travelling paths in the first, second and third audio output holes 16D, 17D, 18D differ from one another, a stereo sound effect can be generated for users to enjoy better auditory feeling.

Figure 15:
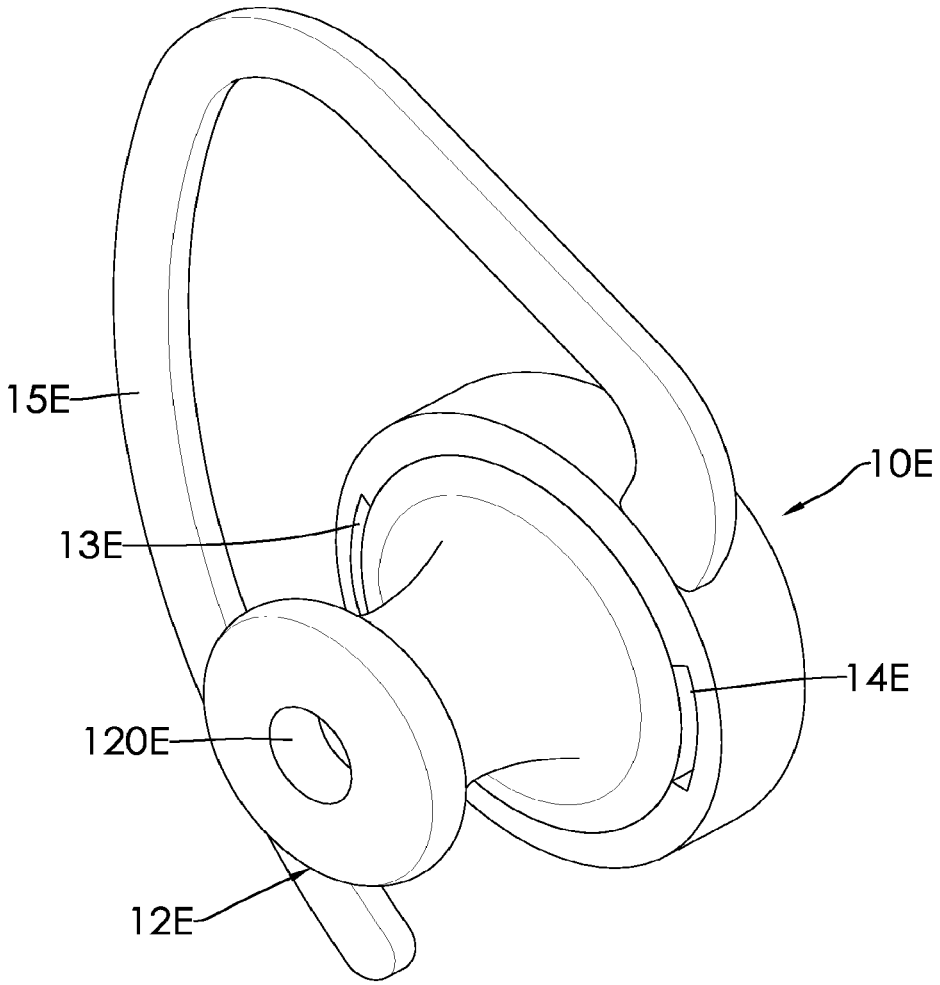
FIG. 15 is a perspective view of a sixth embodiment of a multi-channel headphone in accordance with the present invention.
Figure 16:
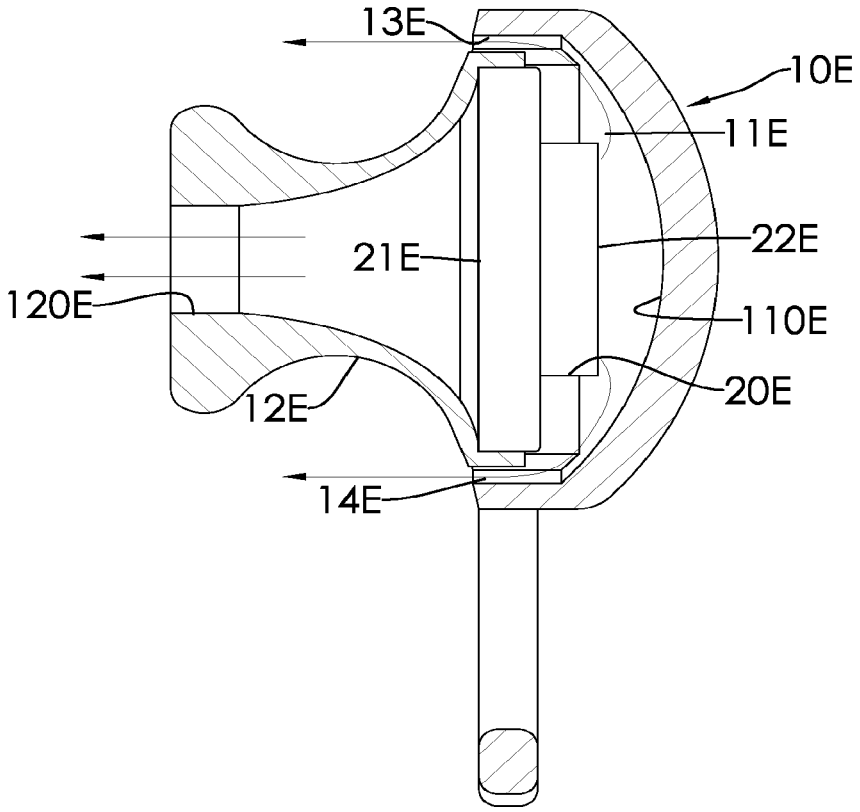
FIG. 16 is a cross-sectional view of the multi-channel headphone in FIG. 15.

With reference to FIGS. 15 and 16, a sixth embodiment of a multi-channel headphone in accordance with the present invention is an ear hook type headphone, and has a housing 10E and a speaker unit 20E.

The housing 10E is disc-shaped, and has a compartment 11E, an ear plug 12E, a second audio output hole 13E, a third audio output hole 14E, and an ear hook 15E. The compartment 11E is formed in an inner side of the housing 10E with an opening at the inner side. The ear plug 12E is mounted in the compartment 11E through the opening, and has a first audio output hole 120E formed through the ear plug 12E to communicate with the compartment 11E. The second audio output hole 13E and the third audio output hole 14E are oppositely formed in a circumferential wall of the housing 10E to communicate with the compartment 11E. The ear hook 15E is connected with the housing 10E.

The speaker unit 20E is a moving-coil speaker, is mounted inside the compartment 11E of the housing 10E and is located at an inner end of the ear plug 12E, is disc-shaped, and has a first sound-generating part 21E and a second sound-generating part 22E. Sound produced by the first sound-generating part 21E directly travels through the opening of the compartment 11E and an opening of the first audio output hole 120E. The second sound-generating part 22E and an inner wall of the compartment 11E are spaced apart. A sound wall 110E is formed on the inner wall of the compartment 11E. The sound wall 110E faces the second sound-generating part 22E, the second audio output hole 13E and the third audio output hole 14E. Sound produced by the second sound-generating part 22E is refracted by the sound wall 110E before travelling through the second audio output hole 13E and the third audio output hole 14E instead of directly travelling through the second audio output hole 13E and the third audio output hole 14E.

When the present embodiment is in use, the ear plug 12E is inserted into the outer ear of a user's ear with an opening of the first audio output hole 120E directly facing the auditory canal of the outer ear and the second audio output hole 13E and the third audio output hole 14E located in the pinna of the outer ear and facing an inner wall of the pinna. When the first sound-generating part 21E and the second sound-generating part 22E of the speaker unit 20 simultaneously produce sound, the sound produced by the first sound-generating part 21E travels to the auditory canal through the first audio output hole 120E, and the sound produced by the second sound-generating part 22E is first refracted by the sound wall 110E and then travels to the auditory canal through the second audio output hole 13E and the third audio output hole 14E. As the sound produced by the second sound-generating part 22E is refracted before travelling to the auditory canal, the travelling speed of the sound produced by the second sound-generating part 22E to the auditory cannel is slower than that of the sound produced by the first sound-generating part 21E such that multiple layers of auditory feeling can be provided. Because the first audio output hole 12E and the second audio output hole 13E and the third audio output hole 14E are independently formed and sound-travelling paths in the first, second and third audio output holes 12E, 13E, 14E differ from one another, a stereo sound effect can be generated for users to enjoy better auditory feeling.

Figure 17:
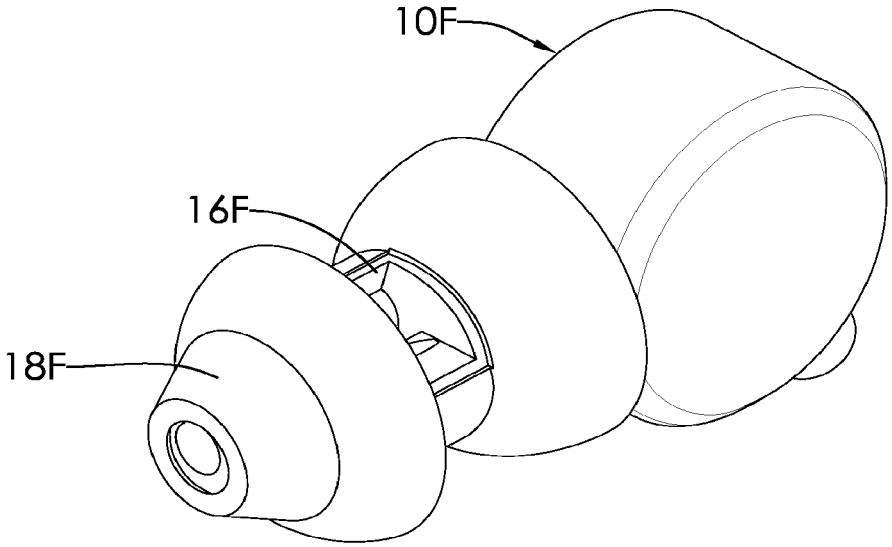
FIG. 17 is a perspective view of a seventh embodiment of a multi-channel headphone in accordance with the present invention.
Figure 18:
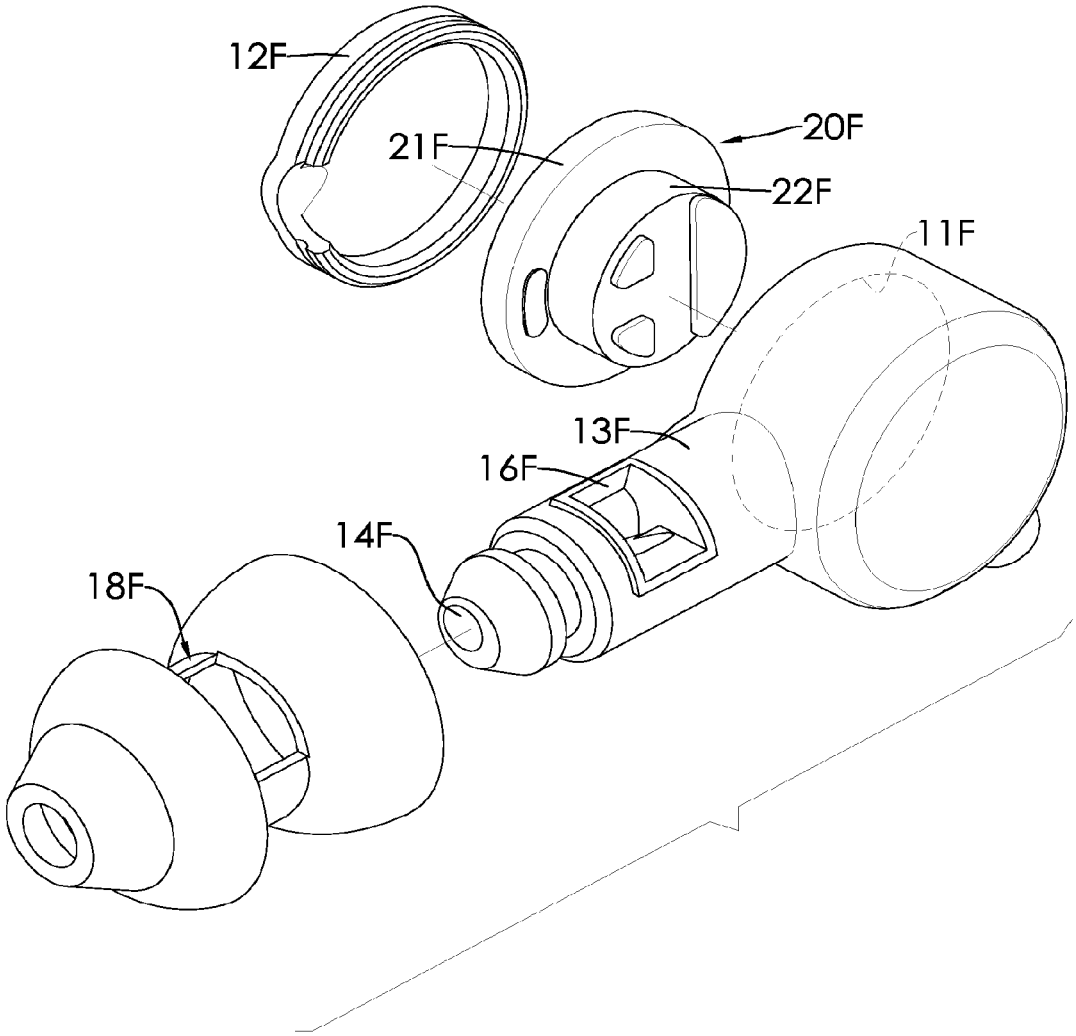
FIG. 18 is an exploded perspective view of the multi-channel headphone in FIG. 17.

With reference to FIGS. 17 and 18, a seventh embodiment of a multi-channel headphone in accordance with the present invention is canal type headphone, and has a housing 10F and a speaker unit 20F.

Figure 19:
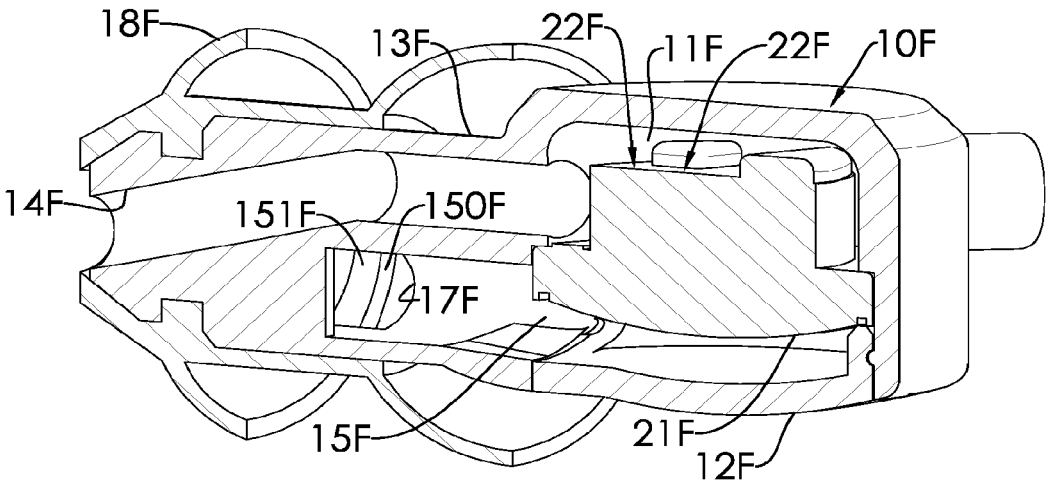
FIG. 19 is a cross-sectional view of the multi-channel headphone in FIG. 17.
Figure 20:
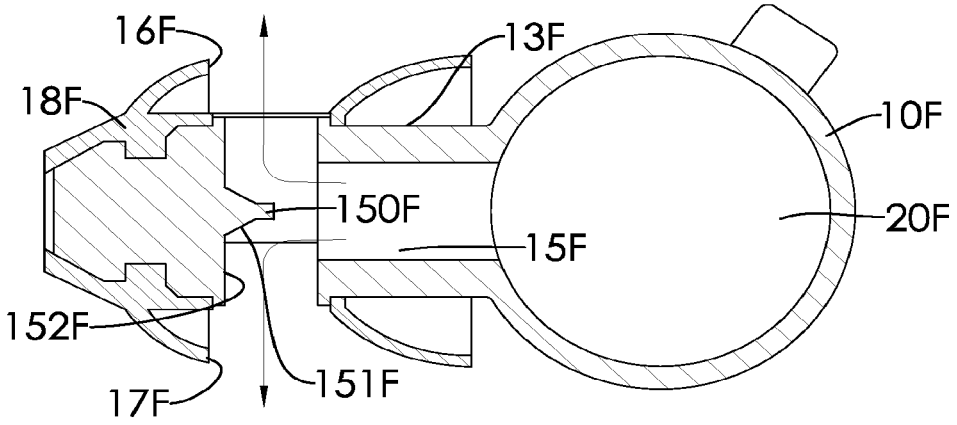
FIG. 20 is another cross-sectional view of the multi-channel headphone in FIG. 17.

The housing 10F has a cylindrical portion and a canal insertion tube 13F connected with a curve surface of the cylindrical portion. The cylindrical portion has a compartment 11F, an opening, and a lid 12F. The compartment 11F is formed on and recessed inwards from one of two bases of the cylindrical portion. The opening of the cylindrical portion communicates with the compartment 11F. The lid 12F covers the opening of the cylindrical portion. With reference to FIGS. 19 and 20, the canal insertion tube 13F has a first audio output hole 14F, a sound-guiding channel 15F, a second audio output hole 16F, a third audio output hole 17F, and a cap 18F. The first audio output hole 14F is formed in an inner end of the canal insertion tube 13F to communicate with the compartment 11F through one sidewall of the compartment 11F. The sound-guiding channel 15F is formed inside the canal insertion tube 13F. One end of the sound-guiding channel 15F communicate with the compartment 11F through another sidewall of the compartment 11F, and the other end of the sound-guiding channel 15F is located inside the canal insertion tube 13F, is adjacent to an opening of the first audio output hole 14F, and has a dividing wall 150F and two blocking walls 152F. The dividing wall 150F has two bevel surfaces 151F formed on two sides of the dividing wall 150F. The blocking walls 152F are respectively formed on the bevel surfaces 151F of the dividing wall 150F. The second audio output hole 16F and the third audio output hole 17F are oppositely formed through a peripheral wall of the canal insertion tube 13F to both communicate with the sound-guiding channel 15F. Openings of the second audio output hole 16F and the third audio output hole 17F respectively face the bevel surfaces 151F of the dividing wall 150F. The cap 18F is mounted around the inner end of the canal insertion tube 13F, is made of rubber and has openings formed through the cap 18F to respectively correspond to the first audio output hole 14F, the second audio output hole 16F and the third audio output hole 17F.

The speaker unit 20F is a moving-coil speaker, is disc-shaped, is mounted inside the compartment 11F of the housing 10F and has a first sound-generating part 21F and a second sound-generating part 22F mounted on two sides of the speaker unit 20F. The first sound-generating part 21F and the lid 12F are spaced apart, and sound produced by the first sound-generating part 21F is refracted by an inner wall of the lid 12F. The second sound-generating part 22F and the inner wall of the housing 10F are spaced apart, and sound produced by the second sound-generating part 22F is refracted by an inner wall of the housing 10F.

When the present embodiment is in use, the canal insertion tube 16F and the cap 18F are placed in the outer ear of a user's ear with the opening of the first audio output hole 14*f* directly facing the auditory canal of the outer ear and the second audio output hole 16F and the third audio output hole 17F located in the pima of the outer ear and facing an inner wall of the pinna. When the first sound-generating part 21F and the second sound-generating part 22F of the speaker unit 20F simultaneously produce sound, the sound produced by the second sound-generating part 22F is refracted by the inner wall of the housing 10F and then directly travels to the auditory canal through the first audio output hole 14F, and the sound produced by the first sound-generating part 21F is refracted by the inner wall of the lid 12F, is then guided to the sound-guiding channel 15F, and travels to the auditory canal after being further refracted by the dividing wall 150F, two bevel surfaces 151F of the dividing wall and the blocking walls 152F. As the sound produced by the first sound-generating part 21F is retracted a couple of times, the travelling speed of the sound produced by the first sound-generating part 21F to the auditory cannel is slower than that of the sound produced by the second sound-generating part 22F such that multiple layers of auditory feeling can be provided. Because the first audio output hole 14F and the second audio output hole 16F and the third audio output hole 17F are independently formed and sound-travelling paths in the first, second and third audio output holes 14F, 15F, 16F differ from one another, a stereo sound effect can be generated for users to enjoy better auditory feeling.

Figure 21:
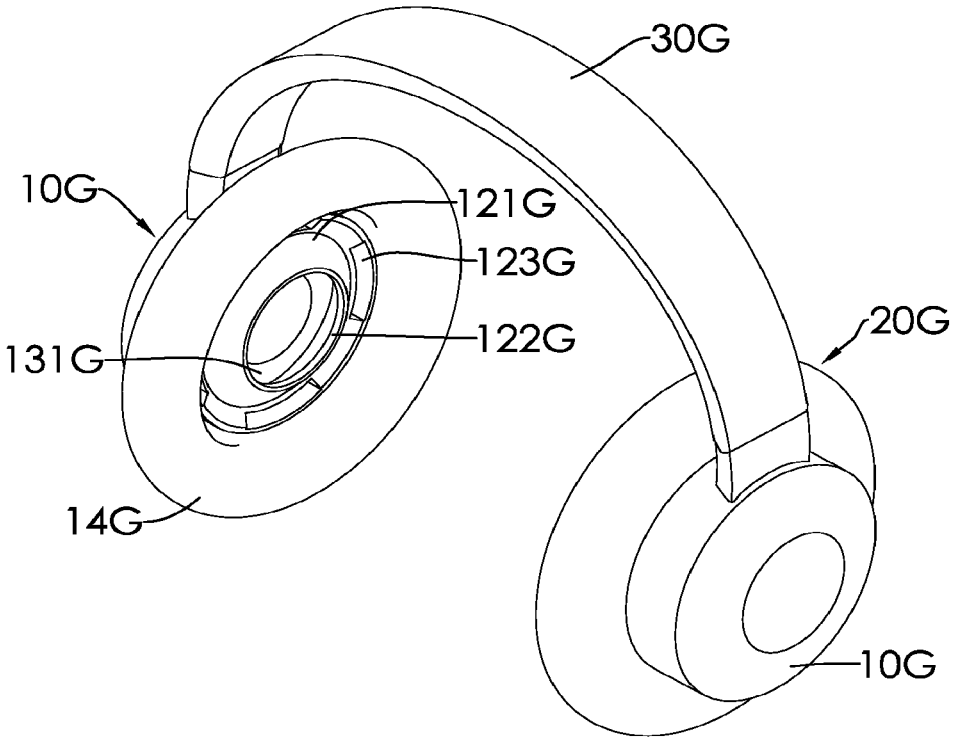
FIG. 21 is a perspective view of an eighth embodiment of a multi-channel headphone in accordance with the present invention.
Figure 22:
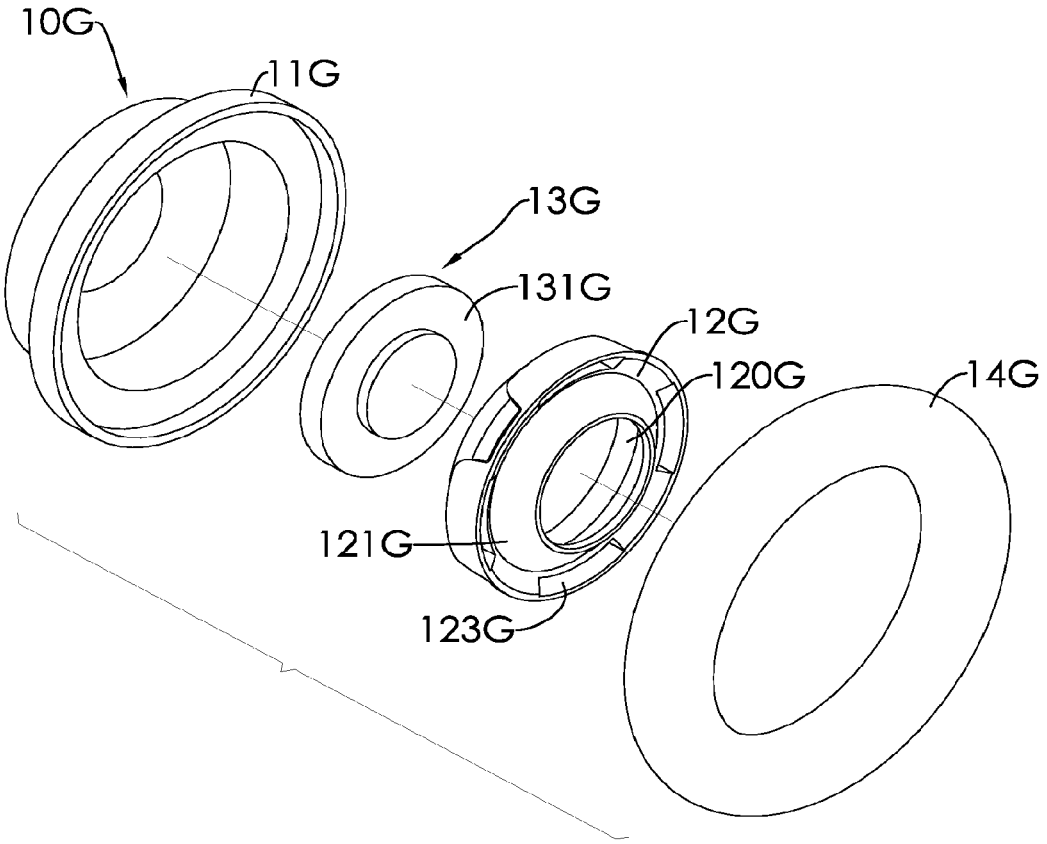
FIG. 22 is an exploded perspective view of the multi-channel headphone in FIG. 21.
Figure 23:
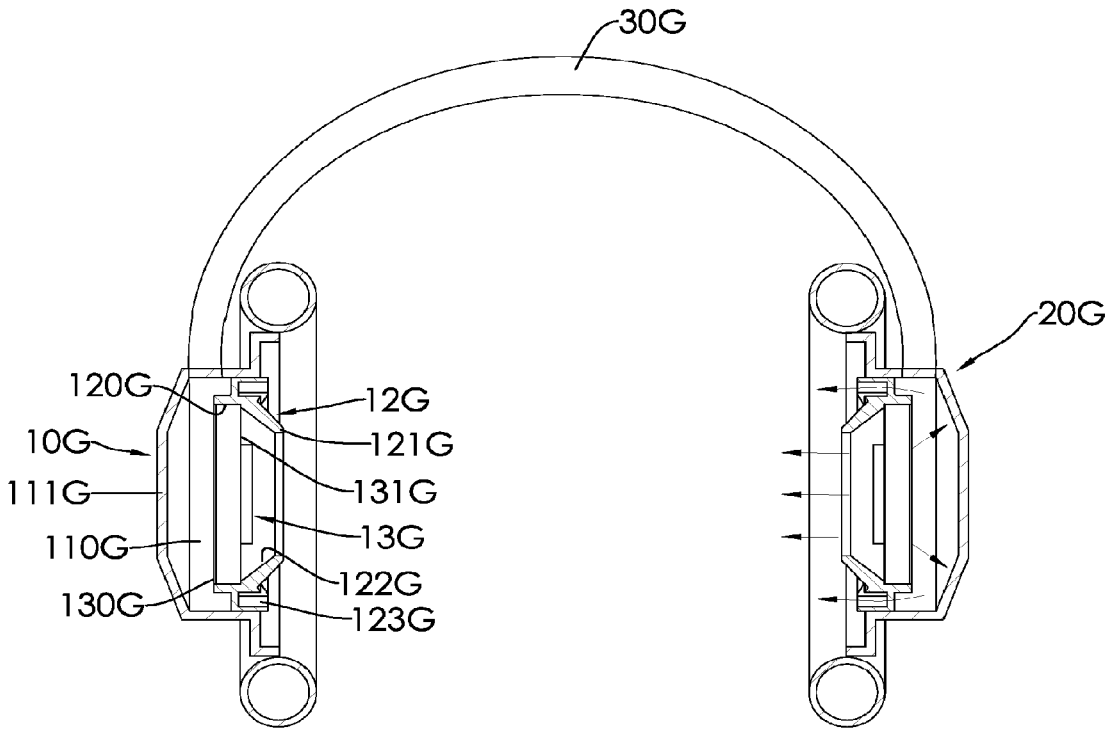
FIG. 23 is a cross-sectional view of the multi-channel headphone in FIG. 21.
Figure 24:
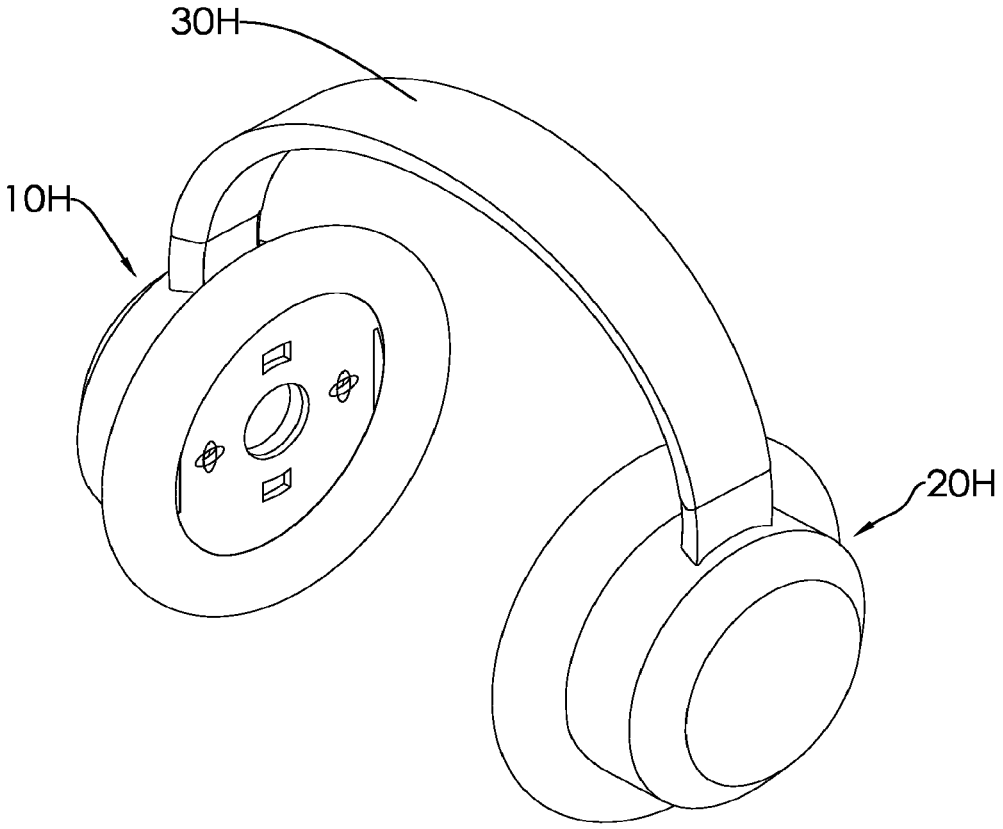
FIG. 24 is a perspective view of a ninth embodiment of a multi-channel headphone in accordance with the present invention.
Figure 25:
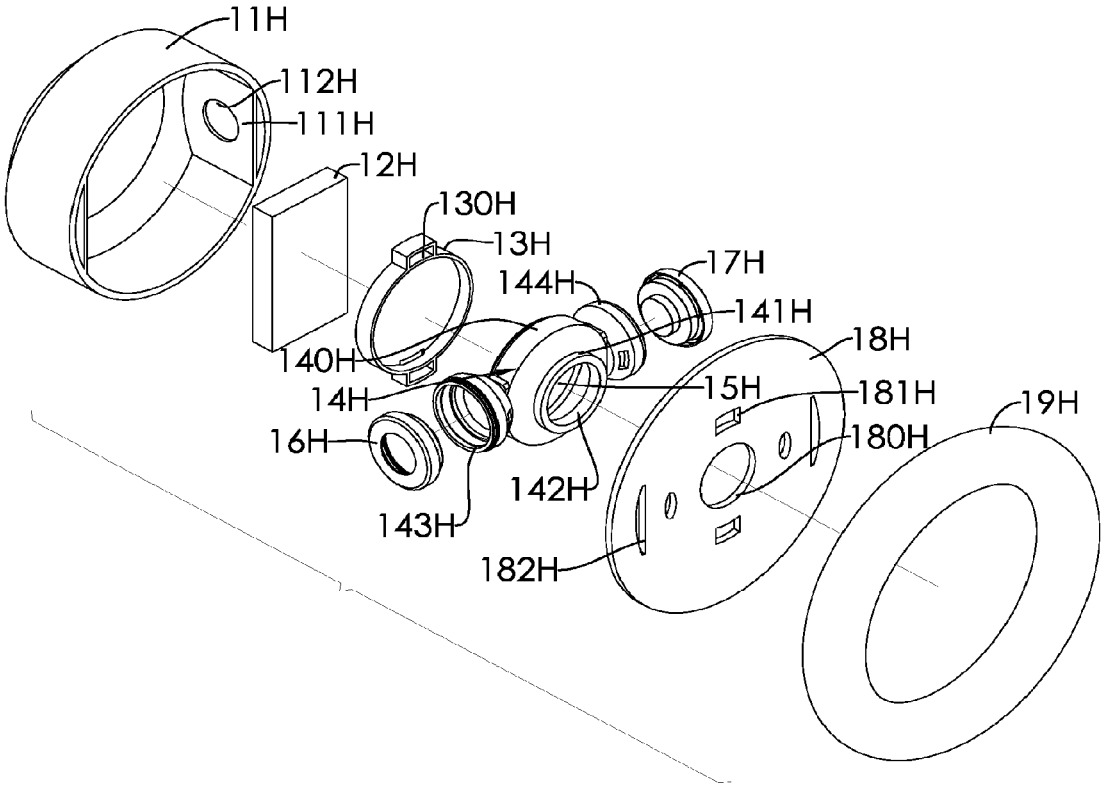
FIG. 25 is an exploded perspective view of the multi-channel headphone in FIG. 24.
Figure 27:
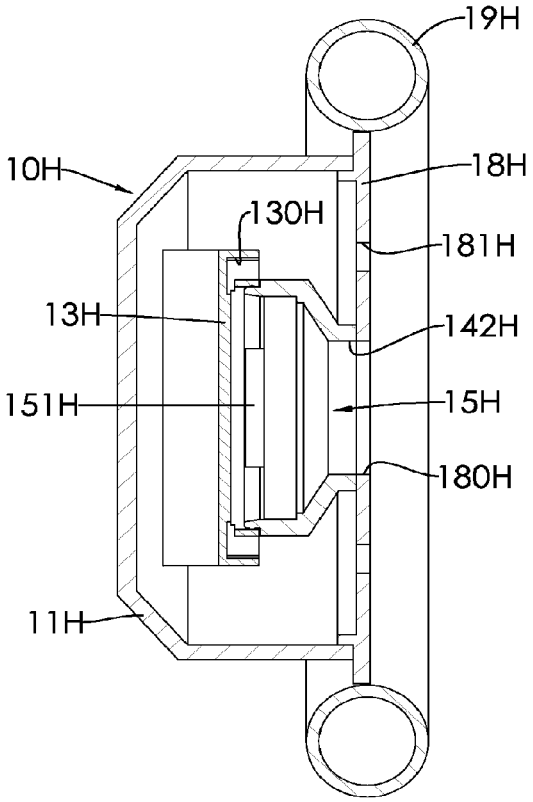
FIG. 27 is another cross-sectional view of the multi-channel headphone in FIG. 24.
Figure 26:
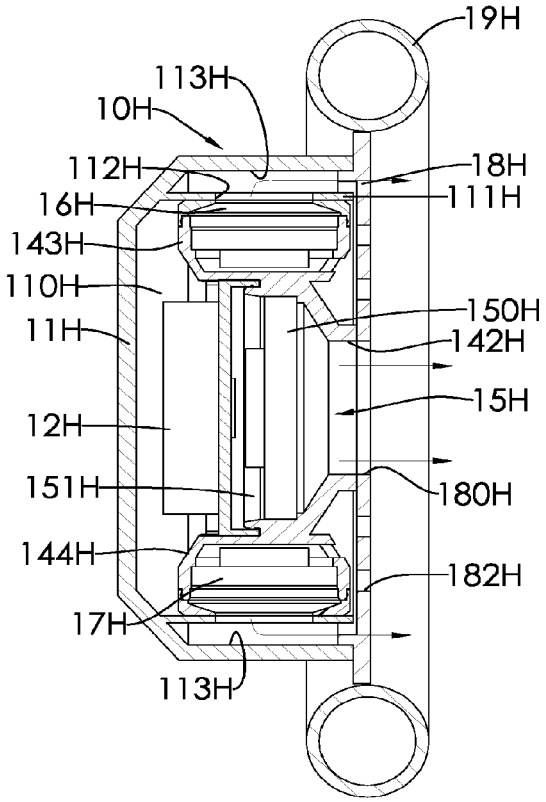
FIG. 26 is a cross-sectional view of the multi-channel headphone in FIG. 24.

With reference to FIGS. 21 to 23, an eighth embodiment of a multi-channel headphone in accordance with the present invention is an on-ear type headphone, and has a left speaker unit 10G, a right speaker unit 20G and a headband 30G.

The left speaker unit 10G has a housing 11G, a sound-guiding member 12G, a speaker unit 13G and an ear cushion 14G. The housing 11G is hollow and disc-shaped, and has a compartment 110G defined inside the housing 11G. The sound-guiding member 12G has a mounting portion 120G, a sound-guiding piece 121G and multiple second audio output holes 123G. The mounting portion 120G is centrally formed in the sound-guiding member 12G and has a chamber defined therein. The sound-guiding piece 121G is dish-shaped, and is formed on the mounting portion 120G with a tapered peripheral wall, and has a first audio output hole 122G and multiple second audio output holes 123G. The first audio output hole 122G is formed through an inner side of the sound-guiding piece 121G and communicates with the chamber of the mounting portion 120G. The second audio output holes 123G are formed in a circumferential edge portion of the sound-guiding member 12G and are spaced apart from each other. The speaker unit 13G is a moving-coil speaker, is disc-shaped, is mounted inside the mounting portion 120G of the sound-guiding member 12G and has a first sound-generating part 130G and a second sound-generating part 131E. Sound produced by the second sound-generating part 131G directly travels through the first audio output hole 122G. The first sound-generating part 130G is spaced apart from an inner wall of the compartment 110G, and is refracted by the inner wall of the compartment 110G. A sound wall 111G is formed on the inner wall of the compartment 110G, A central portion of the sound wall 111G faces an opening of the first sound-generating part 130G of the speaker unit 13G. A bordering portion of the sound wall 111G faces openings of the second audio output holes 123G. The ear cushion 14G is mounted around an edge portion of the housing 11G.

The right speaker unit 20G is structurally the same as the left speaker unit and is thus not repeated.

The headband 30G is a resilient and arc-shaped plate and is connected between the left speaker unit 10G and the right speaker unit 20G.

When the present embodiment is in use, the left speaker unit 10G and the right speaker unit 20G are respectively placed on the left ear and the right ear of a user. The headband 30G provides a suitable holding force for respectively holding the left speaker unit 10G and the right speaker unit 20G on the left ear and the right ear.

As to the travelling direction of sound produced by the present embodiment, given the left speaker unit 10G as an example, sound produced by the second sound-generating part 131G directly travels to the auditory canal through the first audio output hole 122G, and sound produced by the first sound-generating part 130G is refracted by the sound wall and travels to the auditory canal through the second audio output holes 123G. As the sound produced by the first sound-generating part 130G is retracted before reaching the auditory canal, the travelling speed of the sound produced by the first sound-generating part 130G to the auditory cannel is slower than that of the sound produced by the second sound-generating part 131G such that multiple layers of auditory feeling can be provided. Because the first audio output hole 130F and the second audio output hole 131F are independently formed and sound-travelling paths in the first and second audio output holes 130F, 131F differ from each other, a stereo sound effect can be generated for users to enjoy better auditory feeling.

With reference to FIGS. 24 to 27, a ninth embodiment of a multi-channel headphone in accordance with the present invention has a left speaker unit 10H, a right speaker unit 20H and a headband 30H.

The left speaker unit 10H has a housing 11H, a blocking plate 12H, a sound-guiding piece 13H, a mounting frame 14H, three speaker units 15H, 16H, 17H, a covering plate 18H and an ear cushion 19H.

The housing 11H is hollow and disc-shaped, and has a compartment 110H and two guiding walls 111H. The compartment 110H is defined within the housing 11H. The guiding walls 111H are respectively and oppositely mounted on an inner wall of the housing 11H. Each guiding wall 111H has a through hole 112H formed through the guiding wall 111H and spaced apart from the inner wall of the housing 11H. A sound wall 113H is formed on a position on the inner wall of the housing 11H corresponding to each guiding wall 111H.

The blocking plate 12H is mounted inside the compartment 110H. The sound-guiding piece 13H is disc-shaped with one side opened, is mounted on one side of the blocking plate 12H, and has two ears oppositely formed on and protrudes radially from a periphery of the sound-guiding piece 13H. Each ear has a guiding hole 130H formed through the ear. The mounting frame 14H is mounted on the sound-guiding piece 13H, and has a first mounting portion 140H, a first sound-guiding tube 141H, a second mounting portion 143H and a third mounting portion 144H. The first mounting portion 140H is annular and is centrally formed on the mounting frame 14H. The first sound-guiding tube 141H is formed on and protrudes inwards from an inner side of the first mounting portion 140H and has a first guiding hole 142H formed through the first sound-guiding tube 141H. The second mounting portion 143H and the third mounting portion 144H are oppositely formed on a peripheral wall of the first mounting portion 140H.

The speaker units 15H, 16H, 17H include a first speaker unit 15H, a second speaker unit 16H and a third speaker unit 17H. The first speaker unit 15H is a moving-coil speaker, is disc-shaped, is mounted inside the first mounting portion 140H of the mounting frame 14H, and has a first sound-generating part 150H and a second sound-generating part 151H respectively formed on two opposite sides of the first speaker unit 15H. Sound produced by the first sound-generating part 150H directly travels through the first guiding hole 142H. Sound produced by the second sound-generating part 151H is refracted by an inner wall of the sound-guiding piece 13H and then travels through the guiding holes 130H of the sound-guiding piece 13H.

The second speaker unit 16H is mounted on the second mounting portion 143H, and has a sound-generating part facing the through hole 112H of one of the guiding walls 111H in the housing 11H.

The third speaker unit 17H is mounted on the third mounting portion 144H, and has a sound-generating part facing the through hole 112H of the other guiding wall 111H in the housing 11H.

The covering plate 18H is mounted on the housing 11H, and has a first audio output hole 180H, two second audio output holes 181H and two third audio output holes 182H. The first audio output hole 180H is centrally formed through the covering plate 18H. The two second audio output holes 181H are formed through two opposite positions on the covering plate 18H with respect to the first audio output hole 180H. The two third audio output holes 182H are formed through another two opposite positions on the covering plate 18H with respect to the first audio output hole 180H. The first audio output hole 180H communicates with the first guiding hole 142H. The second audio output holes 181H respectively communicates with the guiding holes 130H of the sound-guiding piece 13H. The guiding holes 130H constitute the second guiding holes. Each third audio output hole 182H communicates with a space between one of the guiding walls 111H and one of the sound walls 113H, which constitutes a third guiding hole. The ear cushion 19H is mounted around a peripheral wall of the housing 11H.

The right speaker unit 20H has similar internal structure as the left speaker unit 10H, and is not repeated.

The headband 30H is a resilient and arc-shaped plate, and is connected between the left speaker unit 10H and the right speaker unit 20H.

When the present embodiment is in use, sound produced by the first sound-generating part 150H of the first speaker unit 15H directly travels to the auditory canal of a user through the guidance of the first guiding hole 142H and the first audio output hole 180H. Sound produced by the second sound-generating part 151H of the first speaker unit 15H is refracted by the sound-guiding piece 13H and then travels to the auditory canal through the two second guiding holes 130H and the two second audio output holes 181H.

Sound produced by the sound-generating parts of the second speaker unit 16H and the third speaker unit 17H is refracted and then travels to the auditory canal through the two third guiding holes of the housing 11H and the two third audio output holes 182H. As the sound produced by the first sound-generating part 151H of the first speaker unit 15H is retracted before travelling to the auditory canal, the travelling speed of the sound produced by the first speaker unit 15H to the auditory cannel is slower than that of the sound produced by the second sound-generating part 150H of the first speaker unit 15H such that multiple layers of auditory feeling can be provided. Because the first audio output hole 180H, the second audio output holes 181H and the third audio output holes 182H are independently formed and sound-travelling paths in the first, second and third audio output holes 180H, 181H, 182H differ from one another, a stereo sound effect can be generated for users to enjoy better auditory feeling.

Figures 28, 29:
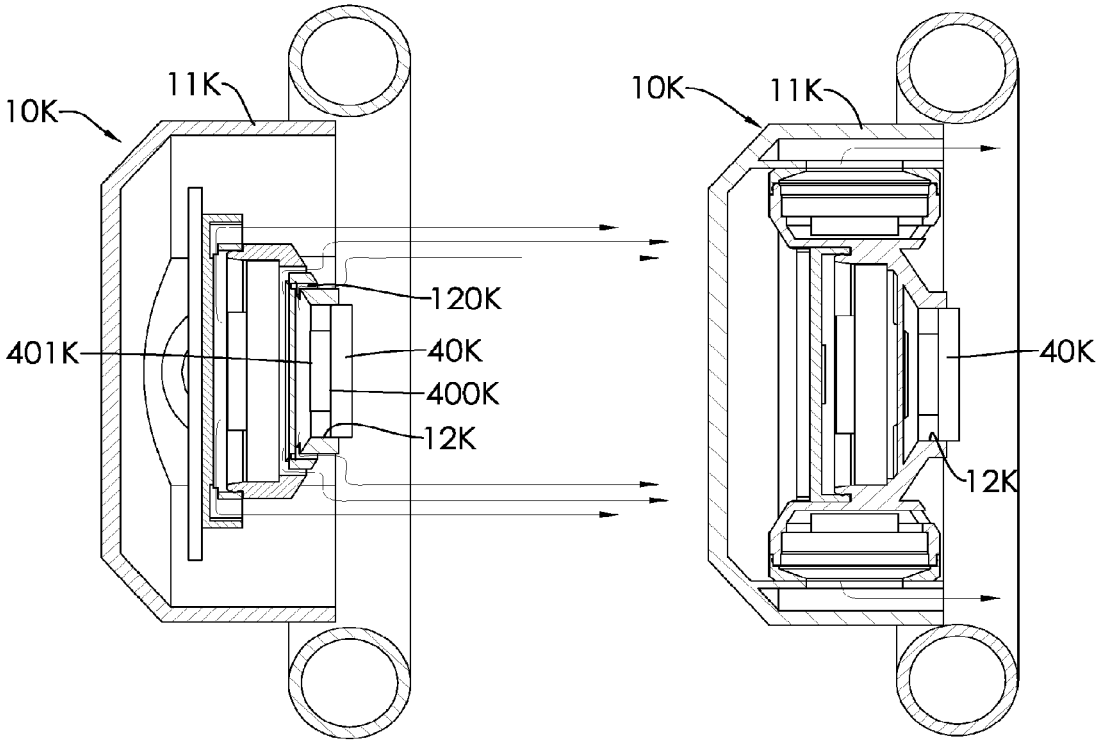
FIG. 28 is a cross-sectional view of a tenth embodiment of a multi-channel headphone in accordance with the present invention.
FIG. 29 is another cross-sectional view of the multi-channel headphone in FIG. 28.

With reference to FIGS. 28 and 29, a tenth embodiment of a multi-channel headphone in accordance with the present invention is a redesign of the ninth embodiment and differs from the ninth embodiment in that each of the left speaker unit 10K and the right speaker unit further has a preliminary speaker unit 40K.

The housing 11K of the left speaker unit 10K has a mounting chamber 12K and two fourth guiding holes 120K.

The mounting chamber 12K is formed on and recessed inwards from an inner side of the housing 11K. The two fourth guiding holes 120K are oppositely formed between the mounting chamber 12K and the first mounting portion 140H of the support frame 14H. The preliminary speaker unit 40K is mounted inside the mounting chamber 12K, and has a first sound-generating part 400K and a second sound-generating part 401K. Sound produced by the first sound-generating part 400K directly travels to the auditory canal of a user through the inner side of the housing 11K. Sound produced by the second sound-generating part 401K travels outside the housing 11K through the two fourth guiding holes 120K for the preliminary speaker unit 40K to serve as a preliminary sound source. The rest of speaker units can serve as a center sound source, an outer sound source and a bass sound source to constitute a real multi-channel headphone.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms is in which the appended claims are expressed.

What is claimed is:

1. A multi-channel headphone, comprising:

a housing having multiple audio output holes formed in the housing;

multiple speaker units mounted inside the housing, each having a sound-generating part mounted thereon, wherein sound produced by one of the sound-generating parts directly travels through one of the audio output holes, and sound produced by the rest of sound-generating parts indirectly travels through the rest of the audio output holes:

wherein the housing has a first compartment, a second compartment and a third compartment defined inside the housing, wherein the second compartment and the third compartment are located at two sides of the first compartment;

a first sound wall formed on the inner wall of the second compartment; and a second sound wall formed on the inner wall of the third compartment;

the audio output holes include a first audio output hole, a second audio output hole and a third audio output hole respectively communicating with the first compartment, the second compartment and the third compartment; and the speaker units include a first speaker unit mounted inside the first compartment, wherein sound produced by a sound-generating part of the first speaker unit directly travels through the first audio output hole;

a second speaker unit mounted inside the second compartment, spaced apart from an inner wall of the second compartment and corresponding to the first sound wall, wherein sound produced by a sound-generating part of the second speaker unit is refracted by the first sound wall; and a third speaker unit mounted inside the third compartment, spaced apart from an inner wall of the third compartment corresponding to the second sound wall, wherein sound produced by a sound-generating part of the third speaker unit is refracted by the second sound wall.

2. The multi-channel headphone as claimed in claim 1, wherein the housing is cylindrical and having two bases, the first audio output hole is centrally formed in one of the bases, the second audio output hole and the third audio output hole are located on two positions of an inner wall of the first audio output hole.

3. The multi-channel headphone as claimed in claim 1, wherein the housing is cylindrical and having a curve surface, a first end and a second end, and the first compartment, and the second compartment and the third compartment are partitioned by partition walls located adjacent to the first end of the housing;

the first audio output hole is formed on and recessed inwards from the first end of the housing;

the second audio output hole and the third audio output hole are radially and oppositely formed through the curve surface of the housing; and sound produced by the sound-generating parts of the speaker units are blocked by the partition walls of the housing.

4. The multi-channel headphone as claimed in claim 3, wherein the first speaker unit is a moving-coil speaker, and the second speaker unit and the third speaker unit are balanced-armature speakers.

* * * * *